US009604814B2

(12) United States Patent
Furuhashi et al.

(10) Patent No.: US 9,604,814 B2
(45) Date of Patent: Mar. 28, 2017

(54) SHEET PROCESSING APPARATUS AND IMAGE FORMING SYSTEM

(71) Applicants: Tomohiro Furuhashi, Kanagawa (JP); Masahiro Tamura, Kanagawa (JP); Shuuya Nagasako, Kanagawa (JP); Keisuke Sugiyama, Tokyo (JP); Kazuya Yamamoto, Kanagawa (JP); Kyosuke Nakada, Kanagawa (JP); Tomomichi Hoshino, Kanagawa (JP); Akira Kunieda, Tokyo (JP); Takahiro Watanabe, Kanagawa (JP); Takamasa Matsumoto, Kanagawa (JP); Junya Suzuki, Kanagawa (JP); Youhei Niitsuma, Kanagawa (JP); Kazunori Konno, Kanagawa (JP); Kiichiro Goto, Kanagawa (JP)

(72) Inventors: Tomohiro Furuhashi, Kanagawa (JP); Masahiro Tamura, Kanagawa (JP); Shuuya Nagasako, Kanagawa (JP); Keisuke Sugiyama, Tokyo (JP); Kazuya Yamamoto, Kanagawa (JP); Kyosuke Nakada, Kanagawa (JP); Tomomichi Hoshino, Kanagawa (JP); Akira Kunieda, Tokyo (JP); Takahiro Watanabe, Kanagawa (JP); Takamasa Matsumoto, Kanagawa (JP); Junya Suzuki, Kanagawa (JP); Youhei Niitsuma, Kanagawa (JP); Kazunori Konno, Kanagawa (JP); Kiichiro Goto, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 96 days.

(21) Appl. No.: 14/594,596

(22) Filed: Jan. 12, 2015

(65) Prior Publication Data

US 2015/0123342 A1 May 7, 2015

Related U.S. Application Data

(63) Continuation of application No. 13/864,734, filed on Apr. 17, 2013, now Pat. No. 8,960,660.

(30) Foreign Application Priority Data

Apr. 17, 2012 (JP) ..... 2012-093994

(51) Int. Cl.
*B65H 31/34* (2006.01)
*B65H 31/40* (2006.01)
(Continued)

(52) U.S. Cl.
CPC ..... *B65H 31/40* (2013.01); *B31F 1/0006* (2013.01); *B31F 1/0035* (2013.01); *B65H 31/26* (2013.01);
(Continued)

(58) Field of Classification Search
CPC ..... B65H 39/00; B65H 45/12; B65H 37/04; B65H 31/34; B31F 1/0006; B31F 1/0035
(Continued)

(56) References Cited

U.S. PATENT DOCUMENTS 6,145,825 A 11/2000 Kunihiro et al.
7,455,291 B2 * 11/2008 Reeves ..... B65H 9/06 271/181
(Continued)

FOREIGN PATENT DOCUMENTS

JP 11-130338 5/1999
JP 2012-166898 A 9/2012

*Primary Examiner* — Leslie A Nicholson, III
(74) *Attorney, Agent, or Firm* — Harness, Dickey & Pierce, P.L.C.

(57) ABSTRACT

According to an embodiment, there is provided a sheet processing apparatus includes a stacking unit that stacks a sheet conveyed thereto; a first alignment unit that aligns the sheet or a bundle of sheets stacked in the stacking unit in a sheet conveying direction; a second alignment unit that aligns the sheet or the bundle of sheets stacked in the stacking unit in a direction orthogonal to the sheet conveying direction; a pressing unit that presses the bundle of sheets at an end portion thereof on a predetermined one side; and a control unit that causes at least one of the first and second alignment units to execute an alignment operation during a press operation of the sheet or the bundle of sheets performed by the pressing unit.

20 Claims, 23 Drawing Sheets

(51) Int. Cl.

| | |
|---|---|
| ***B65H 39/00*** | (2006.01) |
| ***B65H 45/12*** | (2006.01) |
| ***B31F 1/00*** | (2006.01) |
| ***B65H 31/26*** | (2006.01) |
| ***B65H 37/04*** | (2006.01) |

(52) U.S. Cl.
CPC ..... *B65H 31/34* (2013.01); *B65H 37/04* (2013.01); *B65H 39/00* (2013.01); *B65H 45/12* (2013.01); *B65H 2301/4213* (2013.01); *B65H 2301/4214* (2013.01); *B65H 2301/4223* (2013.01); *B65H 2405/211* (2013.01); *B65H 2408/1222* (2013.01); *B65H 2701/1313* (2013.01); *B65H 2701/18292* (2013.01); *B65H 2801/27* (2013.01)

(58) Field of Classification Search
USPC ..... 270/58.07, 58.08, 58.12, 58.16, 58.17, 270/58.27; 271/226, 233, 234, 236, 238, 271/239, 240
See application file for complete search history.

(56) References Cited

U.S. PATENT DOCUMENTS

| | | | | |
|---|---|---|---|---|
| 7,731,169 | B2 | 6/2010 | Saito | |
| 8,123,209 | B2 | 2/2012 | Kubota et al. | |
| 8,191,885 | B2 | 6/2012 | Hattori et al. | |
| 2008/0179809 | A1 | 7/2008 | Kikkawa et al. | |
| 2009/0060604 | A1* | 3/2009 | Hattori ..... | B65H 31/3081 399/361 |
| 2010/0148417 | A1 | 6/2010 | Suzuki et al. | |
| 2010/0207314 | A1 | 8/2010 | Hattori et al. | |
| 2011/0064541 | A1 | 3/2011 | Kikkawa et al. | |
| 2011/0091259 | A1 | 4/2011 | Kobayashi et al. | |
| 2011/0103863 | A1 | 5/2011 | Asami et al. | |
| 2011/0103919 | A1 | 5/2011 | Furuhashi et al. | |
| 2011/0103921 | A1 | 5/2011 | Suzuki et al. | |
| 2011/0266738 | A1 | 11/2011 | Furuhashi et al. | |
| 2012/0146279 | A1 | 6/2012 | Furuhashi et al. | |
| 2012/0207565 | A1 | 8/2012 | Yamamoto | |
| 2012/0294695 | A1 | 11/2012 | Sasaki et al. | |

* cited by examiner

SHEET PROCESSING APPARATUS AND IMAGE FORMING SYSTEM

CROSS-REFERENCE TO RELATED APPLICATIONS

This application is a continuation application of and claims priority under 35 U.S.C. §120/121 to U.S. application Ser. No. 13/864,734 filed Apr. 17, 2013, which claims priority under 35 U.S.C. §119 to Japanese Patent Application No. 2012-093994, filed on Apr. 17, 2012, the contents of each of which are hereby incorporated herein by reference in their entirety and for all purposes.

BACKGROUND OF THE INVENTION

1. Field of the Invention

The present invention relates to a sheet processing apparatus and an image forming system, and more specifically relates to a sheet processing apparatus having an alignment function for aligning a sheet-shaped member such as paper, a recording sheet, transfer paper, or an OHP sheet that is carried in (simply referred to as a "sheet" in the specification including claims), and an image forming system including the sheet processing apparatus, and an image forming apparatus such as a copier, a printer, a facsimile, and a digital MFP.

2. Description of the Related Art

Conventionally known is an apparatus called a finisher including a stapler that stacks sheets discharged from an image forming apparatus into a staple tray, aligns them in a sheet conveying direction (what is called a vertical direction, and the same shall apply hereinafter) and a direction orthogonal to the sheet conveying direction (what is called a width direction, and the same shall apply hereinafter), and then binds the sheets.

An invention described, for example, in Japanese Laid-open Patent Publication No. 11-130338 is known as this type of apparatus. This publication discloses a sheet processing apparatus including a staple tray that accepts and stacks sheets discharged from an image forming apparatus, a trailing end fence against which ends in a conveying direction of the sheets stacked on the staple tray abuts to align the sheets, and a stapling unit that performs a stapling process on the end of the bundle of sheets aligned by the trailing end fence. The sheet processing apparatus includes a pressing member that can move in a thickness direction of the bundle of sheets stacked on the staple tray, and presses a top surface of the sheets in the vicinity of the trailing end fence whenever the predetermined number of sheets is discharged onto the staple tray. The pressing member is for pressing a bundle of sheets to prevent the trailing ends of the sheets from bending and buckling.

In a case of end surface binding performed by the stapler, when sheets are stacked on the staple tray, if the end of a sheet on which the stapling process is performed is curling up or bulging in the thickness direction due to the influence of a curl and the like of the paper, the sheets may not be aligned in vertical and horizontal directions, and thus paper alignment accuracy may be reduced. Hence, in Japanese Laid-open Patent Publication No. 11-130338, a bundle of sheets is pressed by the pressing member in a state where the trailing end of the bundle of sheets is in contact with the reference fence. This pressing member corresponds to a pressing member (trailing end press lever) 110 in FIG. 1 to be described later. The pressing member 110 is located at a lower end of a trailing end reference fence 51 so as to be possible to press the trailing end of a sheet bundle SB housed in the trailing end reference fence 51, and can reciprocate in a substantially vertical direction to an end surface binding processing tray F (refer to FIG. 7 to be described later).

However, in a known sheet holding configuration, the pressing member for pressing and holding a sheet bundle is configured to press a position away from the stapler, considering interference with the stapler. Therefore, a bend and the like occur on the sheet bundle when the bundle is bound with a staple, and it is difficult to obtain excellent alignment accuracy.

Therefore, there is a need for a sheet processing apparatus and an image forming system capable of reliably aligning a bundle of sheets in a sheet conveying direction and a direction orthogonal to the sheet conveying direction even if a curl, a bulge and the like occur on the bundle of sheets to thereby ensure excellent alignment accuracy.

SUMMARY OF THE INVENTION

According to an embodiment, there is provided a sheet processing apparatus includes a stacking unit that stacks a sheet conveyed thereto; a first alignment unit that aligns the sheet or a bundle of sheets stacked in the stacking unit in a sheet conveying direction; a second alignment unit that aligns the sheet or the bundle of sheets stacked in the stacking unit in a direction orthogonal to the sheet conveying direction; a pressing unit that presses the bundle of sheets at an end portion thereof on a predetermined one side; and a control unit that causes at least one of the first and second alignment units to execute an alignment operation during a press operation of the sheet or the bundle of sheets performed by the pressing unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

According to the present invention, in aligning a bundle of sheets in a sheet conveying direction and a direction orthogonal to the conveying direction, the sheet bundle is pressed in its thickness direction, and alignment is performed in a state where a bulge of the paper is regulated. A description will hereinafter be given of an embodiment of the present invention with reference to the drawings.

A description will be given of the embodiment of the present invention, taking an example, with reference to the drawings. In the following description, subscripts a, b . . . are assigned to units having the same configuration or function. However, if these units are collectively described, the subscripts will be omitted.

Figure 1:
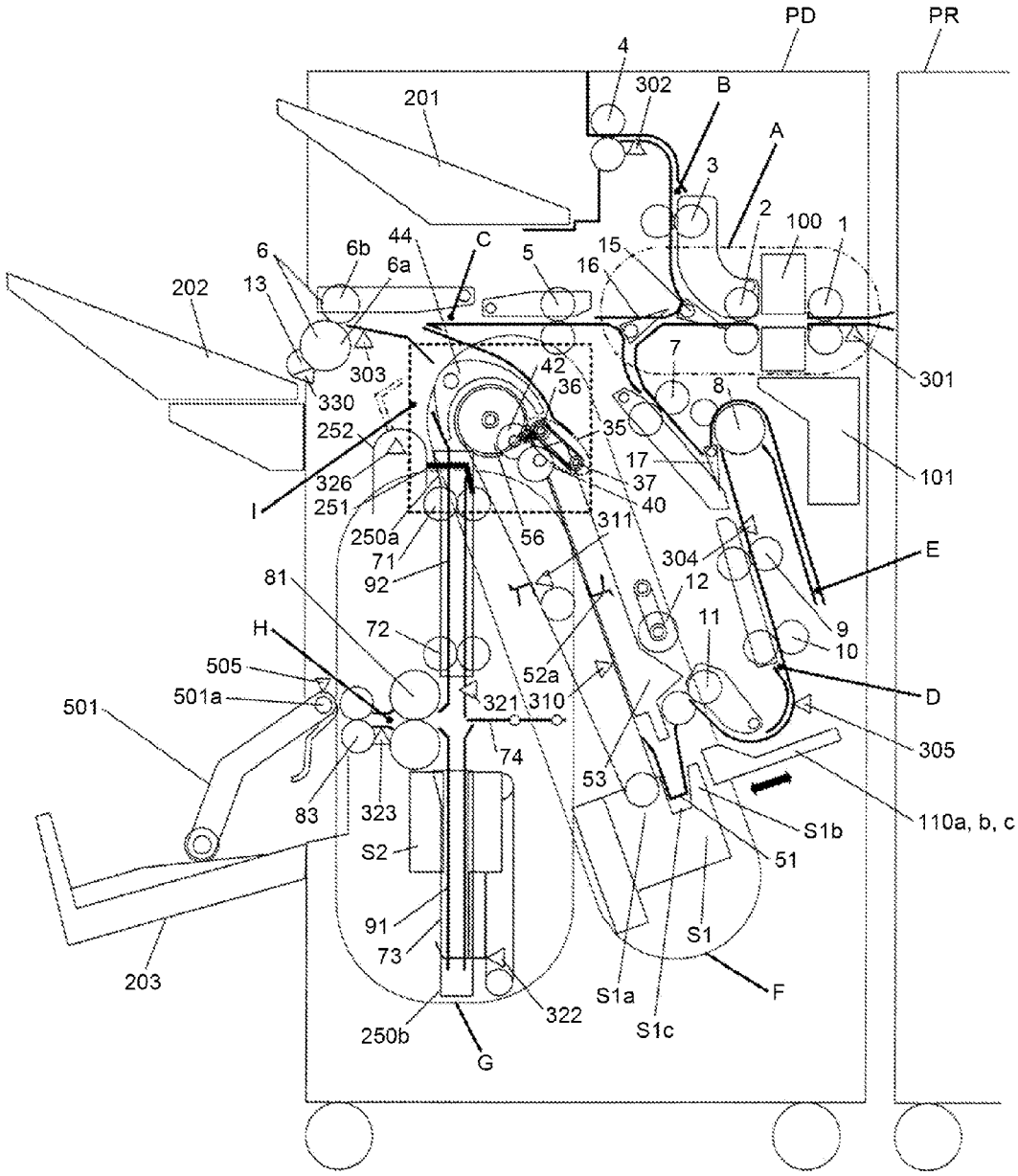
FIG. 1 is a system configuration diagram illustrating a system including a sheet postprocessing apparatus and an image forming apparatus as a sheet processing apparatus according to Example 1 of an embodiment of the present invention.

FIG. 1 is a system configuration diagram illustrating a system including a sheet postprocessing apparatus PD and an image forming apparatus PR as a sheet processing apparatus according to Example 1 of the embodiment.

In FIG. 1, the image forming apparatus PR at least includes an image processing circuit that converts inputted image data to printable image data, an optical writing device that optically writes to a photosensitive element based on an image signal outputted from the image processing circuit, a developing device that develops with toner a latent image formed by optical writing on the photosensitive element, a transfer device that transfers the toner image visualized by the developing device onto a sheet, and a fixing device that fixes the toner image that has been transferred onto the sheet. The image forming apparatus PR sends out the sheet on which the toner image has been fixed to the sheet postprocessing apparatus PD, and a desired postprocessing is performed by the sheet postprocessing apparatus PD. The image forming apparatus PR here is an electrophotographic image forming apparatus as described above, but any known image forming apparatus such as an inkjet image forming apparatus and thermal transfer image forming apparatus can be used. In this example, the image forming unit includes the image processing circuit, the optical writing device, the developing device, the transfer device, and the fixing device.

The sheet postprocessing apparatus PD is attached to a side of the image forming apparatus PR. A sheet discharged from the image forming apparatus PR is guided to the sheet postprocessing apparatus PD. The sheet postprocessing apparatus PD includes a conveying path A, a conveying path B, a conveying path C, a conveying path D and a conveying path H, and the sheet is first conveyed to the conveying path A having a postprocessing unit that postprocesses one sheet (a punch unit 100 as punching means in this example).

The conveying path B is a conveying path that guides the sheet from the conveying path A to an upper tray 201. The conveying path C is a conveying path that guides the sheet to a shift tray 202. The conveying path D is a conveying path that guides the sheet to a processing tray F that performs alignment, staple binding, and the like (hereinafter also referred to as the "end surface binding processing tray").

The sheets from the conveying path A are distributed to the conveying paths B, C and D by means of bifurcating claws 15 and 16.

In this sheet postprocessing apparatus, it is possible to apply, to a sheet, various processing such as punching (the punch unit 100), sheet alignment and end binding (a jogger fence 53 and an end surface binding stapler S1), sheet alignment and saddle stitch binding (a saddle stitch binding upper jogger fence 250*a*, a saddle stitch binding lower jogger fence 250*b* and a saddle stitch binding stapler S2), sheet sorting (the shift tray 202), and middle folding (a folding plate 74 and a folding roller 81). Therefore, the conveying path A, and the following conveying paths B, C and D are selected. Moreover, the conveying path D includes a sheet housing unit E. On the downstream of the conveying path D are the end surface binding processing tray F, a saddle stitch binding middle folding processing tray G, and a discharging conveying path H.

On the conveying path A common to and upstream of the conveying paths B, C and D, an entrance sensor 301 that detects a sheet to be accepted from the image forming apparatus PR, and an entrance roller 1, the punch unit 100, a punched chad hopper 101, a carriage roller 2 and the first and second bifurcating claws 15 and 16, which are downstream of the entrance sensor 301, are sequentially arranged. The first and second bifurcating claws 15 and 16 are held by unillustrated springs in a state illustrated in FIG. 1 (initial state), and are respectively driven by turning on unillustrated first and second solenoids. The turning on/off of the first and second solenoids is selected to change the combination of the bifurcating directions of the first and second bifurcating claws 15 and 16 so that sheets are distributed to the conveying paths B, C and D.

When the sheets are guided to the conveying path B, the state illustrated in FIG. 1, in other words, a state where the first solenoid is OFF (the initial state of the first bifurcating claw 15 is downward) remains. Consequently, the sheets are discharged from a carriage roller 3 to the upper tray 201 through a discharging roller 4.

When the sheets are guided to the conveying path C, the state illustrated in FIG. 1 is changed to a state where the first and second solenoids are turned on (the initial state of the second bifurcating claw 16 is upward) to rotate the bifurcating claw 15 upward and the bifurcating claw 16 downward, respectively. Consequently, the sheets are conveyed to the shift tray 202 side through a carriage roller 5 and a pair of discharging rollers 6 (6*a* and 6*b*). In this case, the sheets are sorted. The sheets are sorted in a shift tray discharging unit located most downstream of the sheet postprocessing apparatus PD. The sheets are sorted by the pair of shift discharging rollers 6 (6*a* and 6*b*), a return roller 13, a paper surface detection sensor 330, the shift tray 202, an unillustrated shift mechanism that reciprocate the shift tray 202 in the direction orthogonal to the sheet conveying direction, and a shift tray lifting mechanism that raises and lowers the shift tray 202.

When the sheets are guided to the conveying path D, the first solenoid that drives the first bifurcating claw 15 is turned on and the second solenoid that drives the second bifurcating claw is turned off to rotate the bifurcating claw 15 upward and the bifurcating claw 16 downward. Accordingly, the sheets are guided from the carriage roller 2 to the conveying path D side through a carriage roller 7. The sheets that have been guided to the conveying path D are guided to the end surface binding processing tray F, where alignment, stapling, and the like are applied to the sheets. The sheets are then distributed by a guide member 44 to the conveying path C that guides to the shift tray 202, and the saddle stitch binding/middle folding processing tray G that folds a sheet, and the like (hereinafter also simply referred to as the "saddle stitch binding processing tray"). When guided to the shift tray 202, the sheet bundle is discharged from the discharging roller pair 6 to the shift tray 202. Moreover, the sheet bundle that has been guided to the saddle stitch binding processing tray G side is folded and bound in the saddle stitch binding processing tray G, and discharged from a discharging roller 83 to a lower tray 203 through the discharging conveying path H.

A bifurcating claw 17 is arranged on the conveying path D, and held by an unillustrated light-load spring in the illustrated state. A sheet can be moved backward along a turn guide 8 by reversing at least a carriage roller 9 between the carriage roller 9, a carriage roller 10 and a staple discharging roller 11 after the trailing end of the sheet conveyed by the carriage roller 7 passes the bifurcating claw 17. With this, the sheet can consequently be guided to the sheet housing unit E from the trailing end of the sheet, prestacked therein, and conveyed with the next sheet while the two sheets are superposed. It is also possible to convey two or more superposed sheets by repeating this operation. A reference numeral 304 denotes a prestack sensor for setting a back-feed timing when prestacking sheets.

When the sheets are guided to the conveying path D, and sheet alignment and end binding are performed thereon, the sheets that have been guided by the staple discharging roller 11 to the end surface binding processing tray F are sequentially stacked into the end surface binding processing tray F. In this case, each sheet is aligned by a tapping roller 12 in the vertical direction, and aligned by the jogger fence 53 in the width direction. During a job break, in other words, during the time from the last sheet of the sheet bundle to the first sheet of the next sheet bundle, the end surface binding stapler S1 as a binding unit is driven by a staple signal from an unillustrated control device to perform a binding process. The sheet bundle on which the binding process has been performed is immediately sent to the shift discharging roller 6 by a release belt 52 having release claws 52*a* protruding therefrom (refer to FIG. 2), and is discharged to the shift tray 202 set to a receiving position.

As illustrated in FIG. 1, the end surface binding stapler S1 includes a stitcher (driver) S1a that projects a staple and a clincher S1b that bends the tips of the staple. Between them is a space S1c that allows trailing end reference fences 51*a* and 51*b* on the front and rear sides to pass therethrough. Accordingly, the end surface binding stapler S1 moves without interfering with the trailing end reference fence 51. Moreover, unlike the saddle stitch binding stapler S2, the stitcher S1a and the clincher S1b are integrated in the end surface binding stapler S1. The stitcher S1a functions as a fixed side without moving in the vertical direction relative to the sheet surface, and the clincher S1b functions as a moving side that moves in the vertical direction relative to the sheet surface. Consequently, if the binding operation is performed on a sheet bundle SB, the clincher S1b moves to the stitcher S1a side a predetermined bound portion of the sheet bundle SB in contact with stacking surfaces 51*a*1 and 51*b*1 of the trailing end reference fences 51*a* and 51*b*. The binding operation is performed in the course of it.

Figure 2:
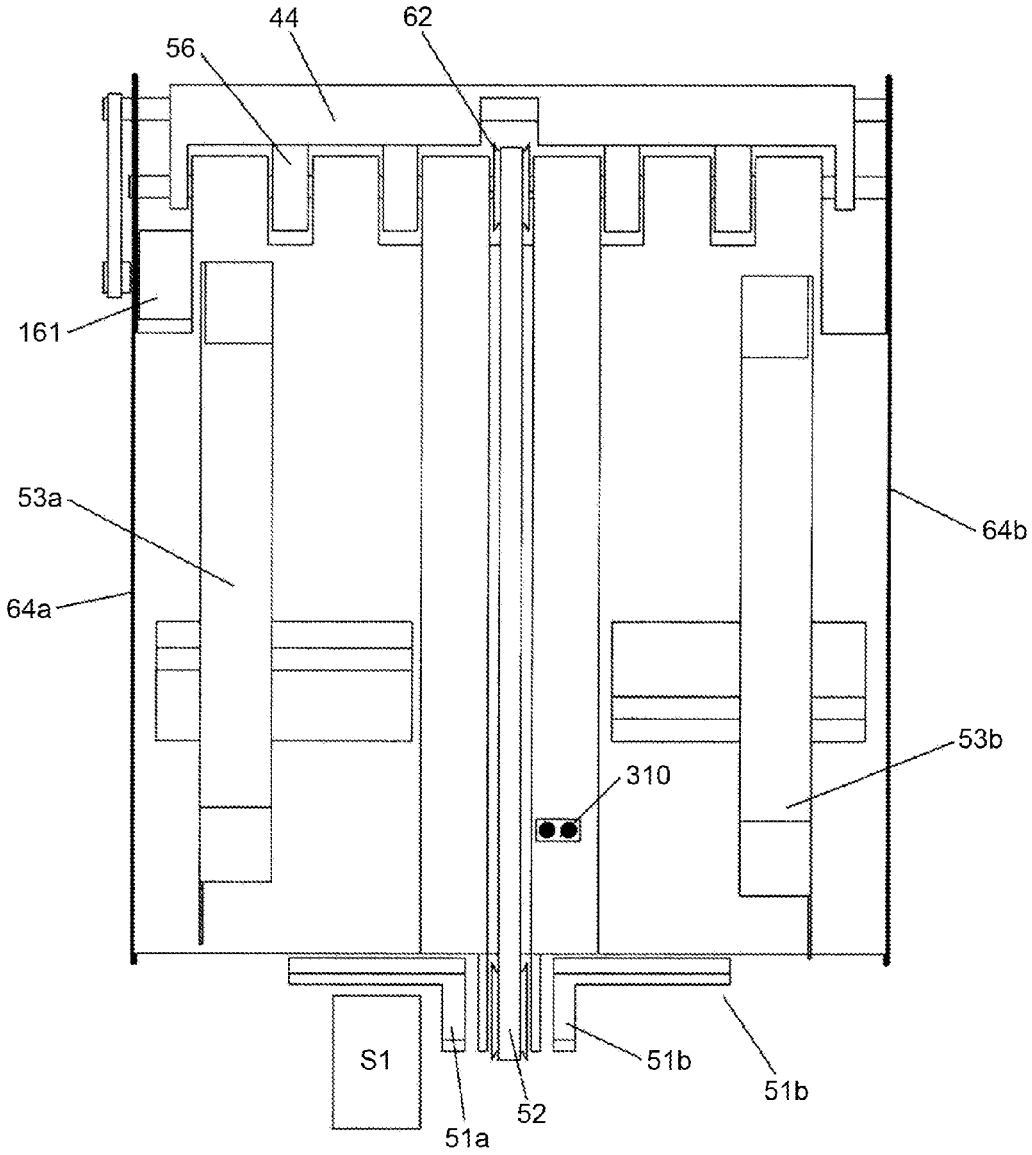
FIG. 2 is a schematic configuration diagram when viewing an end surface binding processing tray in FIG. 1 from a stacking surface side of the tray.
Figure 4:
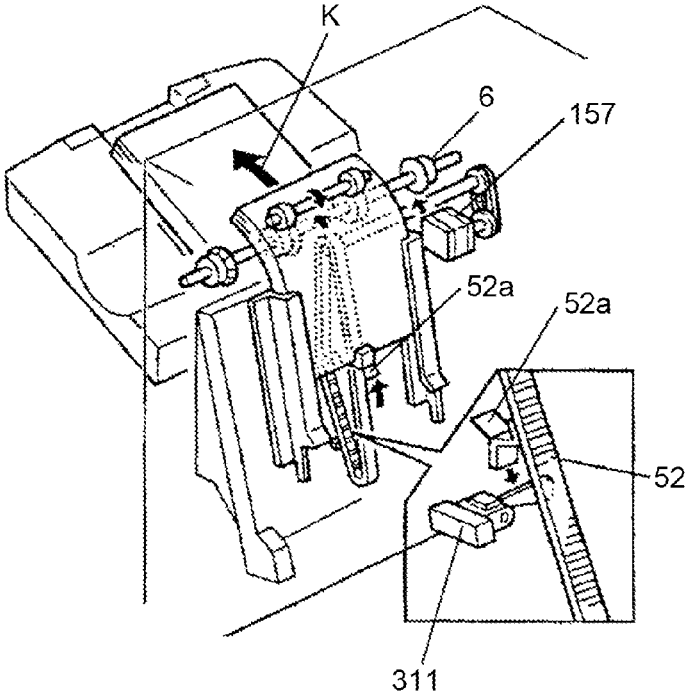
FIG. 4 is a side view illustrating the operation of a release belt in FIG. 1.

As illustrated in FIGS. 2 and 4, the release belt 52 is located at the center of alignment in the sheet width direction, extends between the pulleys 62, and is driven by a release belt drive motor 157. Moreover, a plurality of release rollers 56 is arranged symmetrically about the release belt 52, is provided rotatably to a drive shaft, and functions as driven rollers. FIG. 4 is a side view illustrating the operation of the release belt in FIG. 1, and the arrow K direction is the sheet conveying direction.

The release claw 52*a* is configured such that its home position is detected by a release belt HP sensor 311, which is turned on and off by the release claw 52*a* provided to the release belt 52. Two release claws 52*a* are arranged at opposing positions on the outer periphery of the release belt 52, and move and convey the sheet bundle housed in the end surface binding processing tray F alternately. Moreover, it is also possible to rotate the release belt 52 backward as appropriate, and even the leading end in the conveying direction of the sheet bundle housed in the end surface binding processing tray F with the back of the release claw 52*a* on the opposite side to the release claw 52*a* waiting to move the sheet bundle from now.

Figure 7:
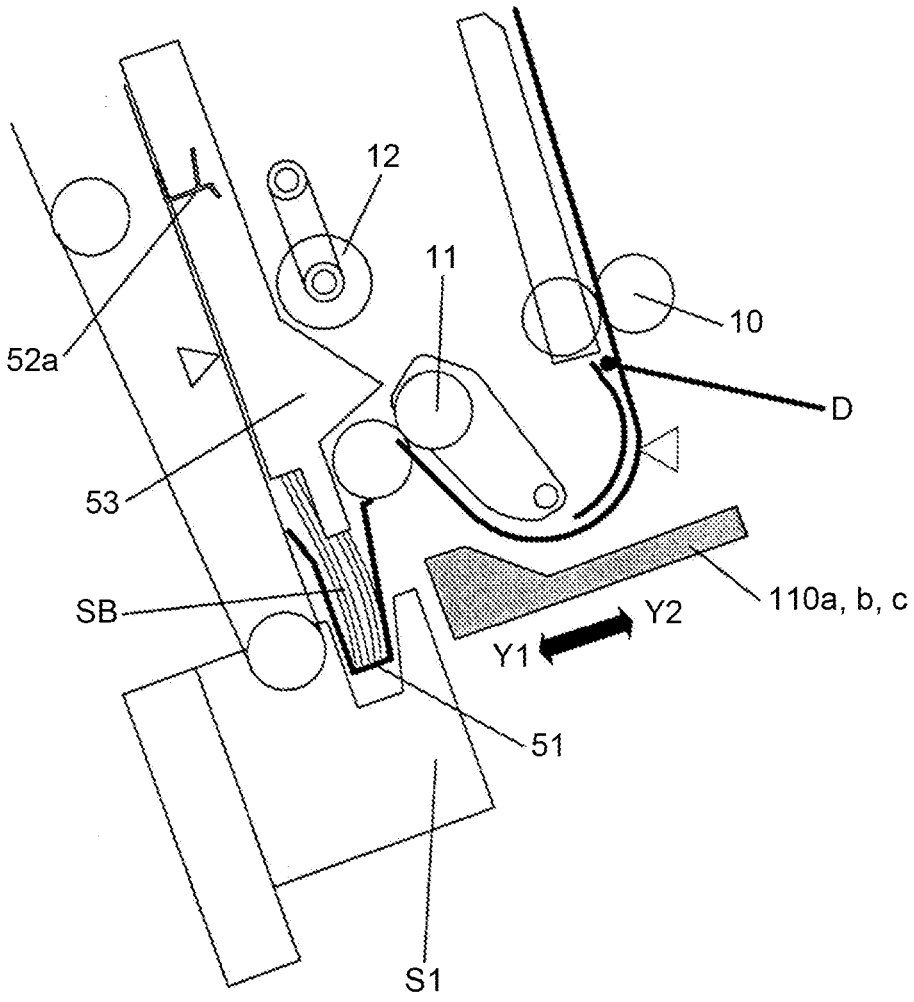
FIG. 7 is a main unit front view illustrating a schematic configuration of a lower part of the end surface binding processing tray.

In FIG. 1, reference numerals 110*a*, 110*b* and 110*c* denote pressing members (trailing end press levers). They are located at a lower end of the trailing end reference fence 51 so as to be possible to press the trailing end of the sheet bundle SB housed in the trailing end reference fence 51, and reciprocate in a substantially vertical direction relative to the end surface binding processing tray F (FIG. 7: an arrow Y1-Y2 direction). Each sheet discharged onto the end surface binding processing tray F is aligned by the tapping roller 12 in the vertical direction. However, if the trailing end of the sheet stacked into the end surface binding processing tray F is curled or too soft, the trailing end tends to buckle and bulge due to the weight of the sheet itself. Furthermore, as the number of stacked sheets increases, a space to accommodate the next sheet in the trailing end reference fence 51 becomes smaller. Therefore, alignment in the vertical direction tends to degrade. Accordingly, in order that a bulge of the trailing end of a sheet is reduced to facilitate sheet entrance into the trailing end reference fence 51, there are provided a pressing mechanism that presses the trailing end of the sheet, and the pressing members 110*a*, 100*b* and 100*c* that directly press a sheet or a sheet bundle. The pressing member is also referred to as a press lever.

Moreover, in FIG. 1, reference numerals 302, 303, 304, 305 and 310 are respectively sheet detection sensors, which detect whether or not a sheet has passed their provided positions or whether or not a sheet has been stacked.

FIG. 2 is a schematic configuration diagram when viewing the end surface binding processing tray F from a stacking surface side of the tray, and corresponds to when viewed from the right side of FIG. 1. In FIG. 2, the sheet accepted from the upstream image forming apparatus PR is aligned by the jogger fences 53*a* and 53*b* in the width direction, and aligned in the vertical direction by being abutted against the trailing end reference fences 51*a* and 51*b* (indicated by the reference numeral 51 in FIG. 1).

Figure 3:
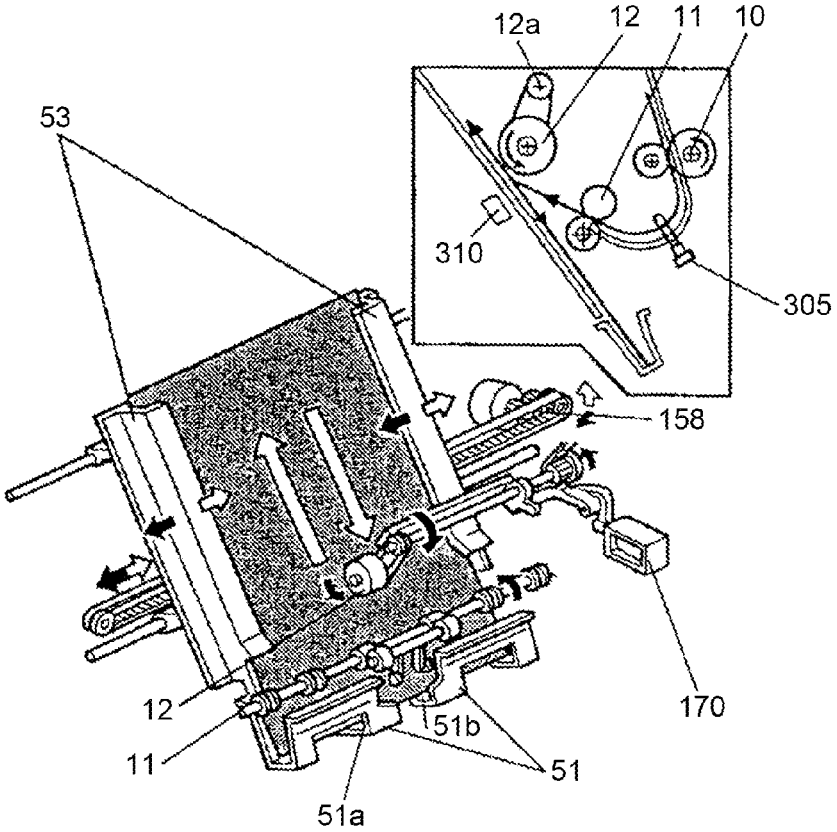
FIG. 3 is a perspective view illustrating a schematic configuration of the end surface binding process tray in FIG. 1 and its attached mechanism.

FIG. 3 is a perspective view illustrating a schematic configuration of the end surface binding processing tray F and its attached mechanism. As illustrated in FIG. 3, sheets guided by the staple discharging roller 11 to the end surface binding processing tray F are sequentially stacked into the end surface binding processing tray F. At this point, if the number of sheets discharged onto the end surface binding processing tray F is one, the sheet is aligned by the tapping roller 12 in the vertical direction, and is aligned by the jogger fences 53*a* and 53*b* in the width direction. The tapping roller 12 is given a pendular movement by a tapping SOL 170 about a fulcrum 12*a*, and intermittently acts on the sheet that has been sent to the end surface binding processing tray F to abut a sheet trailing end ST against the trailing end reference fence 51. The tapping roller 12 itself rotates counterclockwise. A pair of the front and rear jogger fences 53 (53*a* and 53*b*) is provided as illustrated in FIGS. 2 and 3, and driven by a forward and reversely rotatable jogger motor 158 via a timing belt to reciprocate in the sheet width direction. Moreover, if the pair of jogger fences 53*a* and 53*b* is collectively referred to, the reference numeral 53 is simply added for description.

Figure 5:
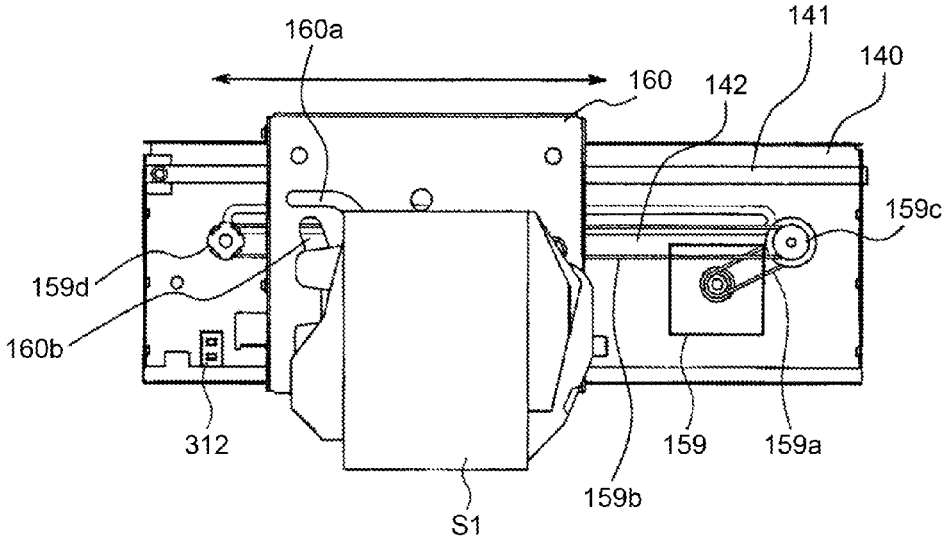
FIG. 5 is a perspective view illustrating a moving mechanism of a stapler in FIG. 1.

FIG. 5 is a side view illustrating a stapler moving mechanism. As illustrated in FIG. 5, the end surface binding stapler S1 is supported slidably in the sheet width direction by a slide shaft 141 supported between both side plates of a support plate 140, and a slide groove 142 formed on the support plate 140 parallel with the slide groove 142. A timing belt 159*b* extends between pulleys 159*c* and 159*d* parallel with the slide shaft 141. The timing belt 159*b* is driven by a forward and reversely rotatable stapler moving motor 159 via a timing belt 159*a*. Since the end surface binding stapler S1 is attached to the timing belt 159*b*, a rotation driving force of the stapler moving motor 159 is transmitted to the end surface binding stapler S1. The end surface binding stapler S1 moves along the slide shaft 141 and the slide groove 142 in the sheet width direction to bind the sheet trailing end at a predetermined position.

At one end of a moving area of the end surface binding stapler S1, a stapler movement HP sensor 312 that detects a home position of the end surface binding stapler S1 is provided, and a binding position in the sheet width direction is controlled by the moving amount of the end surface binding stapler S1 from the home position. The end surface binding stapler S1 is configured such that the sheet trailing end can be bound at one or a plurality of points (generally, two points), and can move at least across the overall width of the sheet trailing end ST supported by the trailing end reference fences 51*a* and 51*b*. Moreover, the end surface binding stapler S1 can move toward the front of the apparatus to the maximum extent possible for replacement of staples to promote a user's convenience of a staple replacement operation.

Figure 6:
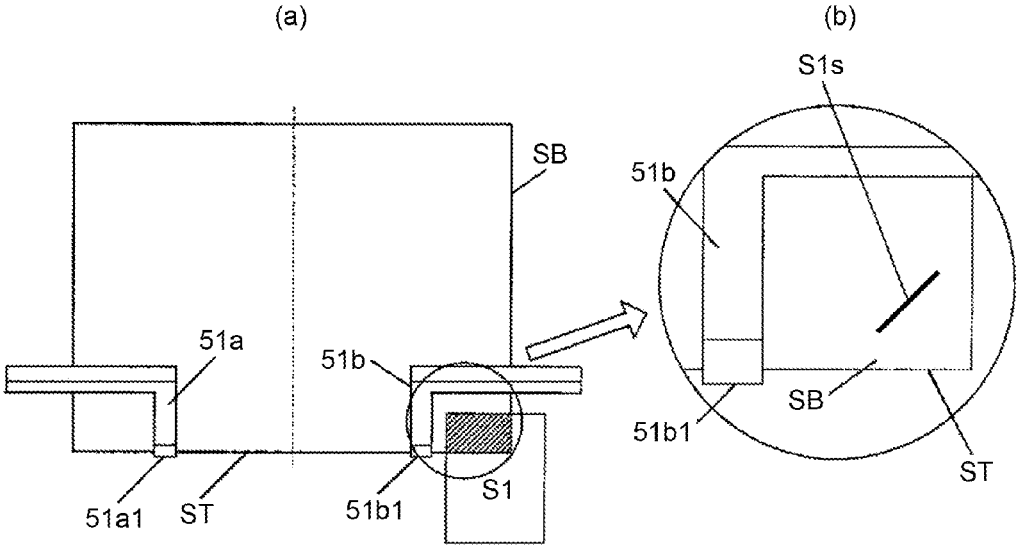
FIG. 6 is a view illustrating a relationship upon end surface binding between sheets stacked on the end surface binding processing tray, a trailing end reference fence and an end surface binding stapler.

FIG. 6 is a view illustrating a relationship upon end surface binding between the sheet bundle SB stacked on the end surface binding processing tray F, the trailing end reference fence 51 and the end surface binding stapler S1. As can be seen from FIG. 6, the trailing end reference fences 51*a* and 51*b* respectively include on their inner sides the stacking surfaces 51*a*1 and 51*b*1 with which the sheet trailing end ST comes into contact, and support the trailing end ST, which leads to the support of the whole sheet bundle SB. It is conventionally common to enable support with four points; however, the embodiment illustrates two-point support, and the position of the sheet trailing end ST is defined by the two points. Moreover, although (a) of FIG. 6 illustrates end surface one-point binding, in the case of one-point diagonal binding, the end surface binding stapler S1 body rotates around an end on the sheet trailing end ST side, from the position of the end surface one-point binding illustrated in (a) of FIG. 6 to a position of a staple S1s illustrated in (b) of FIG. 6, and the end surface binding stapler S1 performs a binding process in a slanting state at a diagonal angle.

As illustrated in (a) of FIG. 6, the sheet bundle SB comes into contact with two points of the stacking surfaces 51*a*1 and 51*b*1 of the trailing end reference fence 51 so as to be stacked. The binding process is then performed by the stapler S1. Enlarged part (b) in FIG. 6 illustrates a relationship after diagonal binding between a staple S1d and the trailing end reference fence 51*b*. After completion of the alignment operation, the binding process is performed by the end surface binding stapler S1. As can be seen from the perspective view of FIG. 4 illustrating the operation of the release belt, the release belt 52 is driven counterclockwise by the release belt drive motor 157, and the sheet bundle subjected to the binding process is scooped by the release claw 52*a* attached to the release belt 52 to be released from the end surface binding processing tray F. Reference numerals 64*a* and 64*b* denote a front side plate and a rear side plate. Moreover, an operation similar to this operation can be performed also on an unbound bundle on which the binding process is not performed after the alignment process.

FIG. 7 is a main unit front view illustrating a schematic configuration of a lower part of the end surface binding processing tray F. In the lower part of the end surface binding processing tray F, the trailing end reference fence 51, the end surface binding stapler S1, and the staple discharging roller 11 are provided. The pressing member 110 is arranged on a side facing the trailing end reference fence 51. As described above, the pressing member 110 is for pressing the trailing end of the sheet bundle SB housed in the trailing end reference fence 51, and is located at the lower end of the trailing end reference fence 51, and can reciprocate in a substantially vertical direction relative to the end surface binding processing tray F (arrows: Y1-Y2 direction). A plurality of (three in this example) the pressing members 110 is provided in the sheet width direction, and the pressing members 110*a*, 110*b* and 110*c* respectively move in the sheet width direction by a mechanism to be described later in synchronization with the end surface binding stapler S1. Moreover, the pressing members 110*a*, 110*b* and 110*c* can perform approaching and separation operations on the sheet bundle SB, and press the trailing end of the sheet bundle SB at a predetermined pressure, and hold the sheet bundle SB in between with the trailing end reference fence 51 upon performing the binding process.

A sheet bundle deflection mechanism I is provided downstream in the sheet conveying direction of the end surface binding processing tray F. As illustrated in FIG. 1, the conveying paths to send the sheet bundle SB from the end surface binding processing tray F to the saddle stitch binding processing tray G and from the end surface binding processing tray F to the shift tray 202, and the conveying units to convey the sheet bundle SB are configured of a conveying mechanism 35 that applies a conveying force to the sheet bundle SB, the release rollers 56 that turn the sheet bundle SB, and the guide member 44 that guides the sheet bundle SB to turn.

More specifically, a driving force of a drive shaft 37 is transmitted by a timing belt to a roller 36 of the conveying mechanism 35. The roller 36 and the drive shaft 37 are coupled and supported by an arm, and are swingable with the drive shaft 37 as a hinged support. The roller 36 of the conveying mechanism 35 is swung and driven by a cam 40. The cam 40 rotates around a rotation shaft, and is driven by an unillustrated motor. In the conveying mechanism 35, a driven roller 42 is arranged at a position facing the roller 36, and the sheet bundle is held between the driven roller 42 and the roller 36, and is pressurized by an elastic member to apply a conveying force.

The conveying path that turns the sheet bundle from the end surface binding processing tray F to the saddle stitch binding processing tray G is formed between the release rollers 56 and the inner surface of the guide member 44 on a side facing the release rollers 56. The guide member 44 rotates around a support, and the drive is transmitted from a bundle bifurcating drive motor 161 (refer to FIG. 2). If the sheet bundle is conveyed from the end surface binding processing tray F to the shift tray 202, the guide member 44 rotates clockwise in the drawing around the support, and the space between the outer surface of the guide member 44 (a surface on a side that does not face the release rollers 56) and a guide plate outside the guide member 44 functions as a conveying path. If the sheet bundle SB is sent from the end surface binding processing tray F to the saddle stitch binding processing tray G, the trailing end of the sheet bundle SB that has been aligned in the end surface binding processing tray F is pushed up by the release claw 52*a*. The sheet bundle is held between the roller 36 of the conveying mechanism 35 and the driven roller 42 facing this to apply a conveying force. At this point, the roller 36 of the conveying mechanism 35 is waiting at a position that does not hit the leading end of the sheet bundle SB. Next, after the leading end of the sheet bundle SB passes, the roller 36 of the conveying mechanism 35 is brought into contact with the sheet surface to apply a conveying force. At this point, the guide member 44 and the release rollers 56 form a guide of the turn conveying path, and convey the sheet bundle SB to the downstream saddle stitch binding processing tray G.

As illustrated in FIG. 1, the saddle stitch binding processing tray G is provided downstream of the sheet bundle deflection mechanism including the conveying mechanism 35, the guide member 44 and the release rollers 56. The saddle stitch binding processing tray G is provided substantially vertically and downstream of the sheet bundle deflection mechanism. A middle folding mechanism is arranged in the center, an upper bundle conveying guide plate 92 above the middle folding mechanism, and a lower bundle conveying guide plate 91 below the middle folding mechanism.

Moreover, an upper bundle carriage roller 71 and a lower bundle carriage roller 72 are respectively provided above and below the upper bundle conveying guide plate 92, and a saddle stitch binding upper jogger fence 250*a* is arranged along both side surfaces of the upper bundle conveying guide plate 92 in a manner of straddling between both the rollers 71 and 72. A saddle stitch binding lower jogger fence 250*b* is similarly provided along both side surfaces of the lower bundle conveying guide plate 91, and the saddle stitch binding stapler S2 is arranged at the place where the saddle stitch binding lower jogger fence 250*b* is arranged. The saddle stitch binding upper jogger fence 250*a* and the saddle stitch binding lower jogger fence 250*b* are driven by an unillustrated drive mechanism to perform the alignment operation in the width direction. The saddle stitch binding stapler S2 has a configuration in which a clincher unit and a driver unit are paired, and two pairs of them are provided with a predetermined interval in the sheet width direction.

Moreover, a movable trailing end reference fence 73 is arranged so as to cross the lower bundle conveying guide 91, and is movable in the sheet conveying direction (the up and down direction in the drawing) by a moving mechanism including a timing belt and its drive mechanism. As illustrated in FIG. 1, the drive mechanism is configured of a drive pulley and a driven pulley, across which the timing belt is laid, and a stepping motor that drives the drive pulley. A trailing end tapping claw 251 and its drive mechanism are similarly provided on the upper end side of the upper bundle conveying guide plate 92. The trailing end tapping claw 251 can reciprocate in a direction to move away from the sheet bundle deflection mechanism, and a direction to push the trailing end of the sheet bundle (the side that hits the trailing end upon introducing the sheet bundle) by a timing belt 252 and an unillustrated drive mechanism.

The middle folding mechanism is provided in substantially the center of the saddle stitch binding processing tray G, and includes the folding plate 74, the folding roller 81, and the conveying path H that conveys the folded sheet bundle. In FIG. 1, a reference numeral 326 denotes a home position sensor for detecting a home position of the trailing end tapping claw 251, a reference numeral 323 a folded portion pass sensor for detecting a sheet folded in the middle, a reference numeral 321 a bundle detection sensor for detecting that a sheet bundle has reached a middle folding position, and a reference numeral 322 a movable trailing end reference fence home position sensor for detecting a home position of the movable trailing end reference fence 73.

Moreover, in this example, a detection lever 501 that detects the height of a stack of the sheet bundle SB that has been folded in the middle on the lower tray 203 is provided so as to be swingable by a support 501*a*. The angle of the detection lever 501 is detected by a paper surface sensor 505 to detect the ascending/descending operation and overflow of the lower tray 203.

Figure 8:
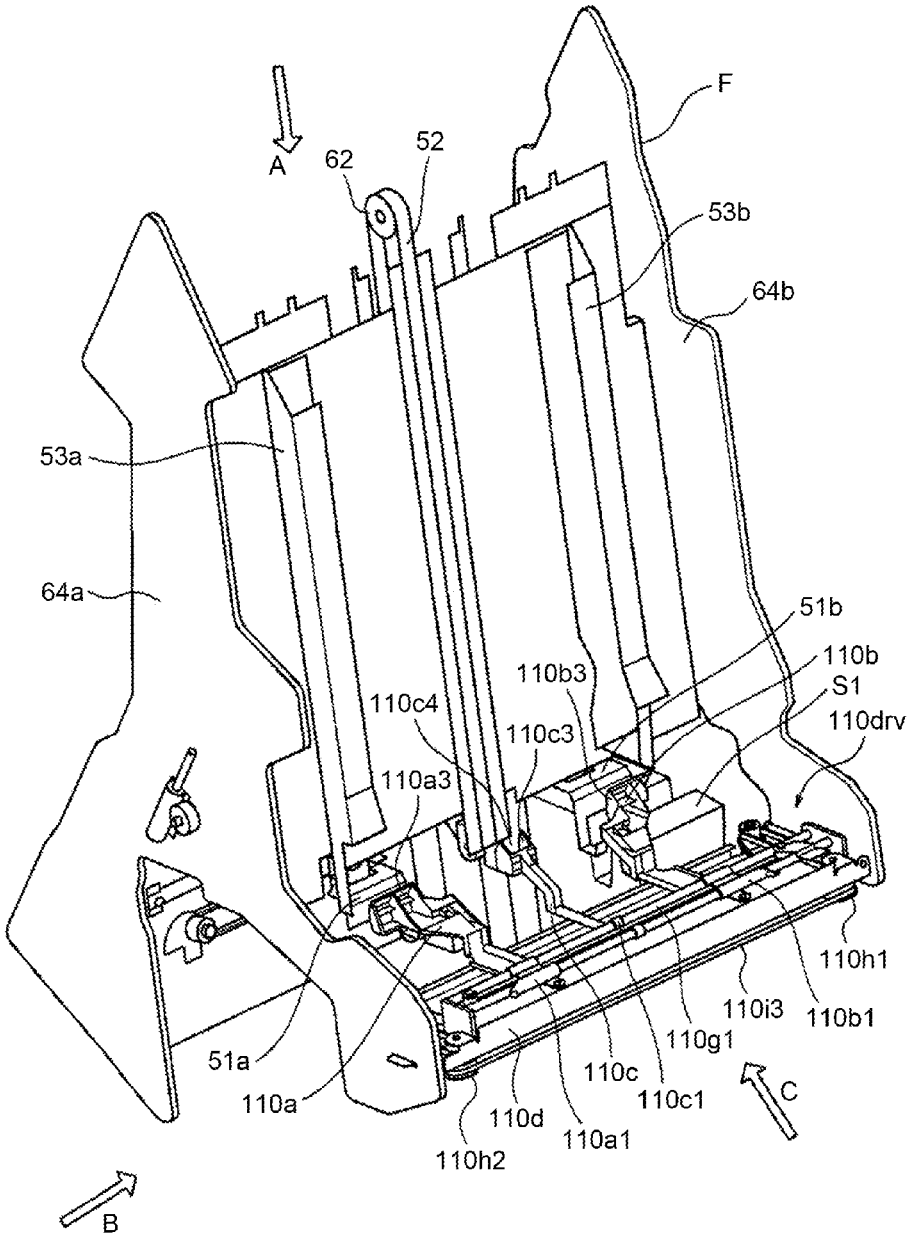
FIG. 8 is a perspective view illustrating in detail a relationship between the end surface binding processing tray illustrated in FIGS. 2 and 3, the trailing end reference fence, and a pressing member.
Figure 9:
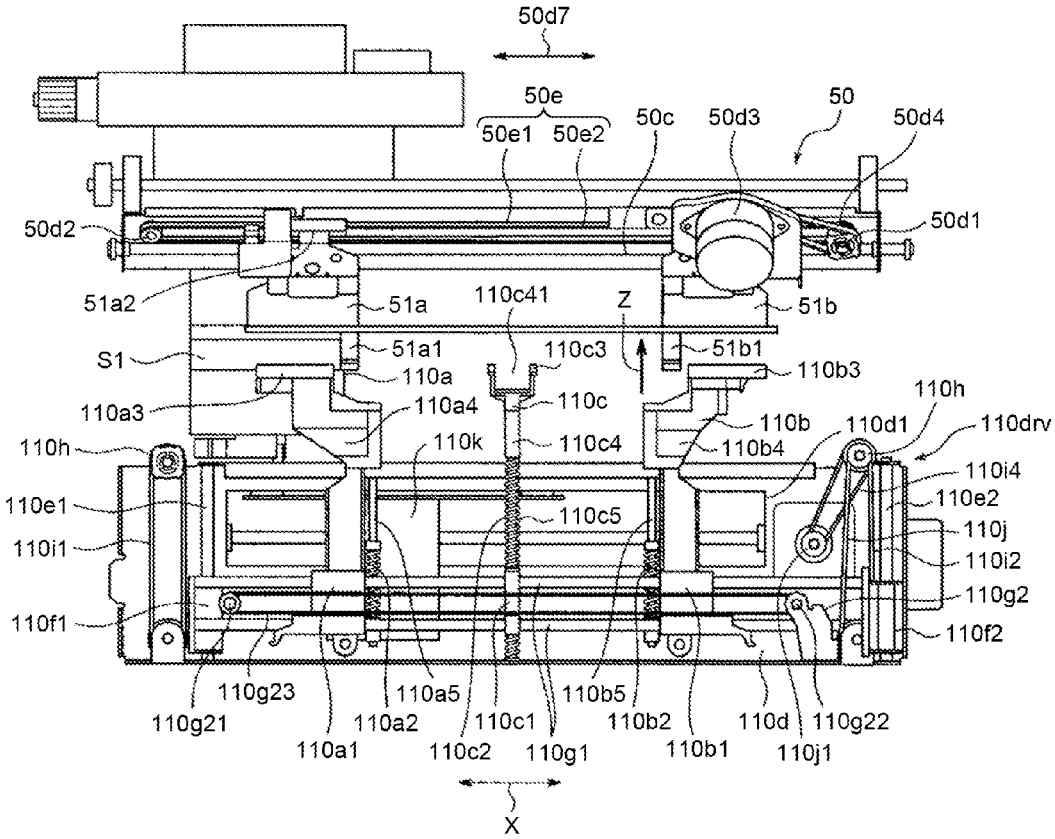
FIG. 9 is a view on arrow A in FIG. 8 in a state where a sheet bundle is not pressed.
Figure 10:
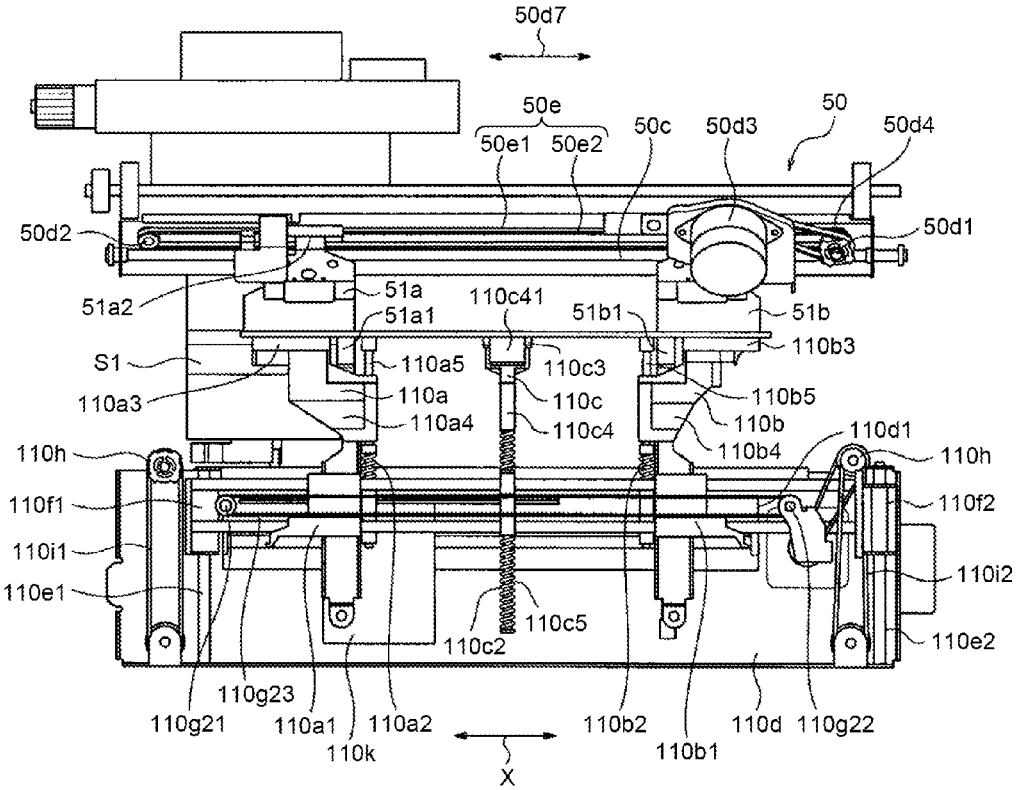
FIG. 10 is a view on arrow A in FIG. 8 in a state where a sheet bundle is pressed.
Figure 11:
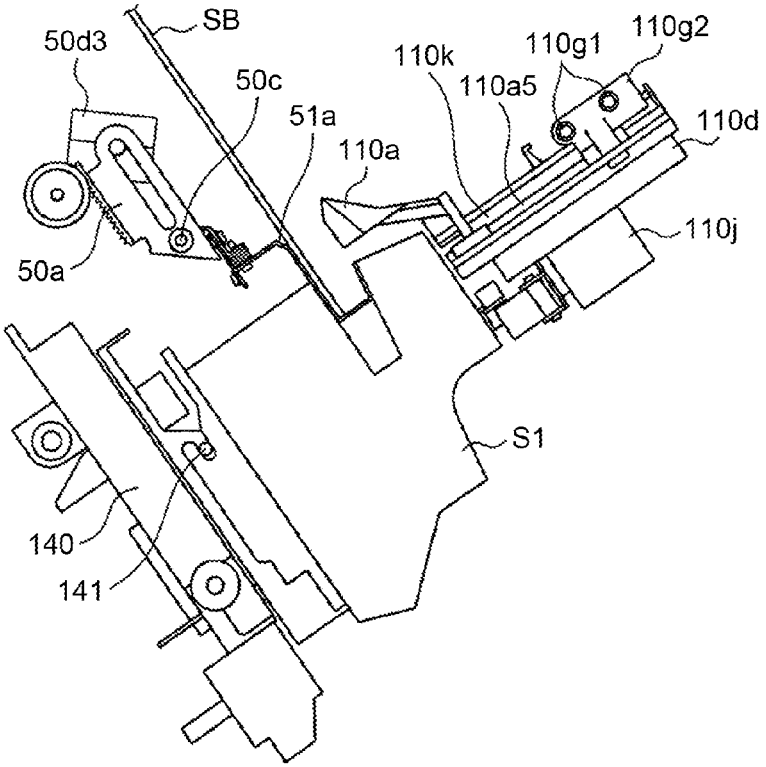
FIG. 11 is a view on arrow B in FIG. 8 in a state where a sheet bundle is not pressed.
Figure 12:
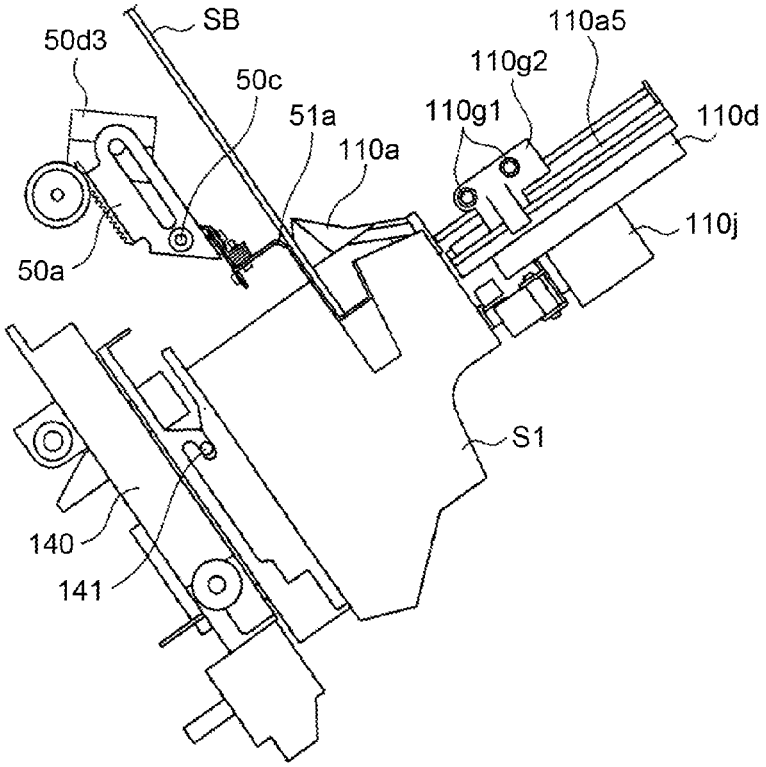
FIG. 12 is a view on arrow B in FIG. 8 in a state where a sheet bundle is pressed.
Figure 13:
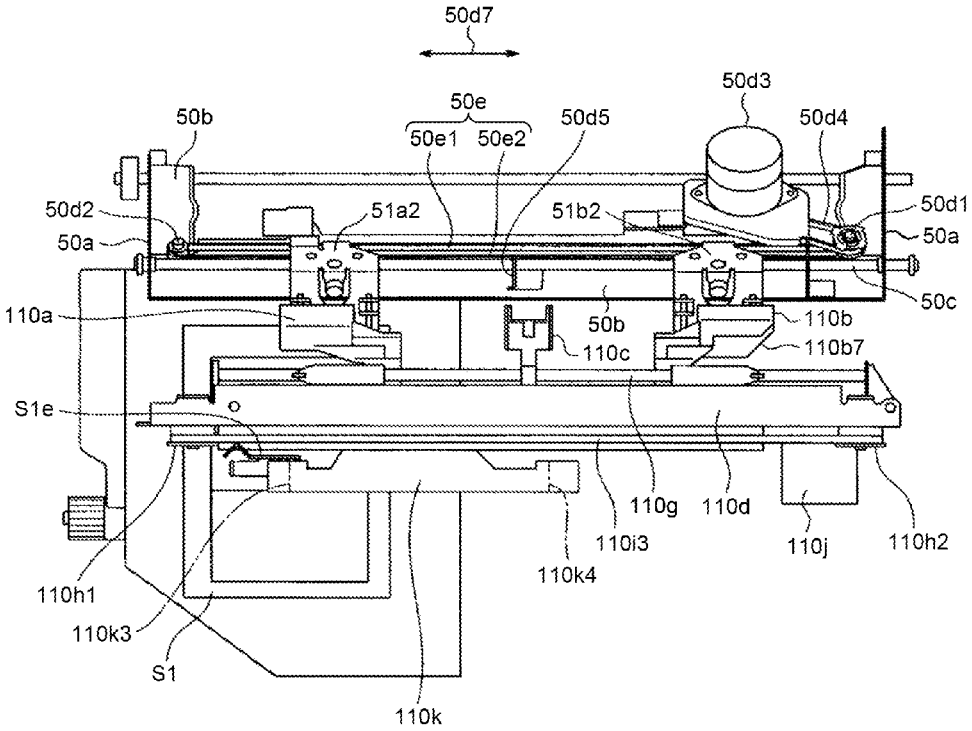
FIG. 13 is a view on arrow C in FIG. 8.
Figure 14:
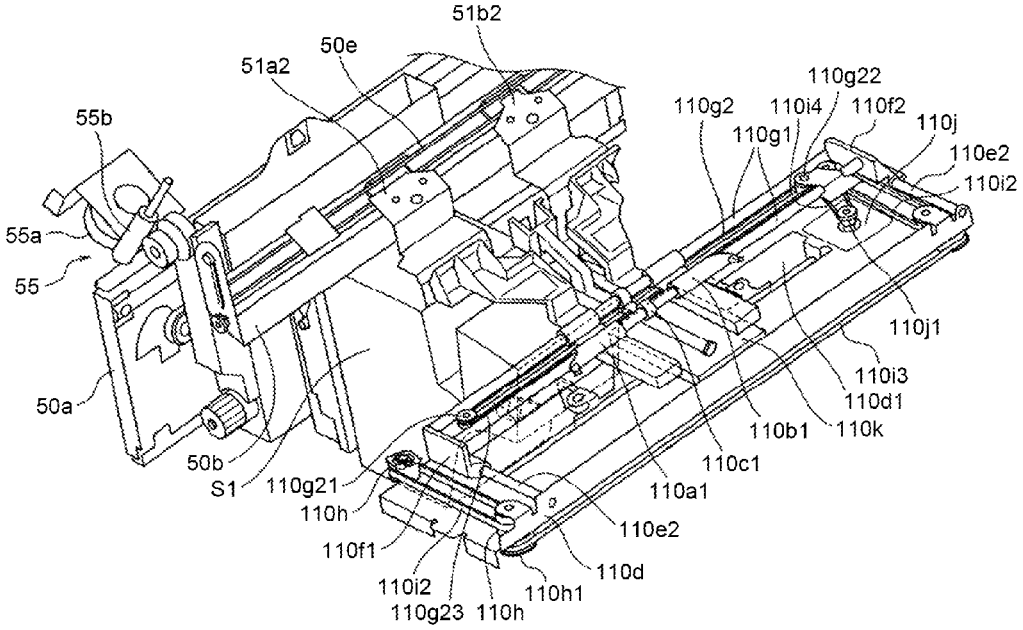
FIG. 14 is a perspective view illustrating main units of the end surface binding processing tray, the trailing end reference fence, and the pressing member.

FIG. 8 is a perspective view illustrating in detail a relationship between the end surface binding processing tray F illustrated in FIGS. 2 and 3, the trailing end reference fence 51, and the pressing member 110. FIG. 9 is a view on arrow A in FIG. 8 in a state where a sheet bundle is not pressed. FIG. 10 is a view on arrow A in FIG. 8 in a state where a sheet bundle is being pressed. FIG. 11 is a view on arrow B in FIG. 8 in a state where a sheet bundle is not pressed. FIG. 12 is a view on arrow B in FIG. 8 in a state where a sheet bundle is being pressed. FIG. 13 is a view on arrow C in FIG. 8. FIG. 14 is a perspective view illustrating main units of the end surface binding processing tray F, the trailing end reference fences 51*a* and 51*b*, and the pressing member 110. The views on arrow A are views when viewing the end surface binding processing tray F from above, parallel with a surface of a sheet whose trailing end is supported by the trailing end reference fences 51*a* and 51*b*. The views on arrow B are views when viewing the end surface binding processing tray F from the left side, parallel with a surface of a sheet whose trailing end is supported by the sheet surface by the trailing end reference fences 51*a* and 51*b*. The view on arrow C is a view when viewing the end surface binding processing tray F from the front.

As can be seen from these drawings, the pair of trailing end reference fences 51*a* and 51*b* is arranged in the lower part of the end surface binding processing tray F. The first and second pressing members 110*a* and 110*b* are arranged at positions facing their respective trailing end reference fences 51*a* and 51*b*. The third pressing member 110*c* is provided at a position between them, the position facing the release belt 52. The three pressing members 110*a*, 110*b* and 110*c* are supported by a support member 110*d* in a movable manner in a vertical direction relative to the sheet bundle SB and a direction parallel with the sheet surface, and can reciprocate by a pressing member drive mechanism 110*drv* in the vertical direction relative to the sheet bundle SB.

The pressing member drive mechanism 110*drv* is configured of the following mechanism mounted on the support member 110*d*.

In other words, the support member 110*d* is provided at both ends with a pair of first guide shafts 110*e*1 and 110*e*2 extending in the vertical direction relative to the sheet surface. First and second sliders 110*f*1 and 110*f*2 are slidably attached to the guide shafts 110*e*1 and 110*e*2, respectively. Between the first and second sliders 110*f*1 and 110*f*2, two second guide shafts 110*g*1 and a slide base 110*g*2 are provided. A first slider portion 110*a*1 and a second slider portion 110*b*1, which are slider portions of the first and second pressing members 110*a* and 110*b*, are slidably attached to the second guide shafts 110*g*1. A base 110*c*1 of the third pressing member 110*c* is fixed to the centers of the second guide shafts 110*g*1. Moreover, first and second pulleys 110*g*21 and 110*g*22 are provided to the slide base 110*g*2, and a timing belt 110*g*23 extends between them.

Figure 15:
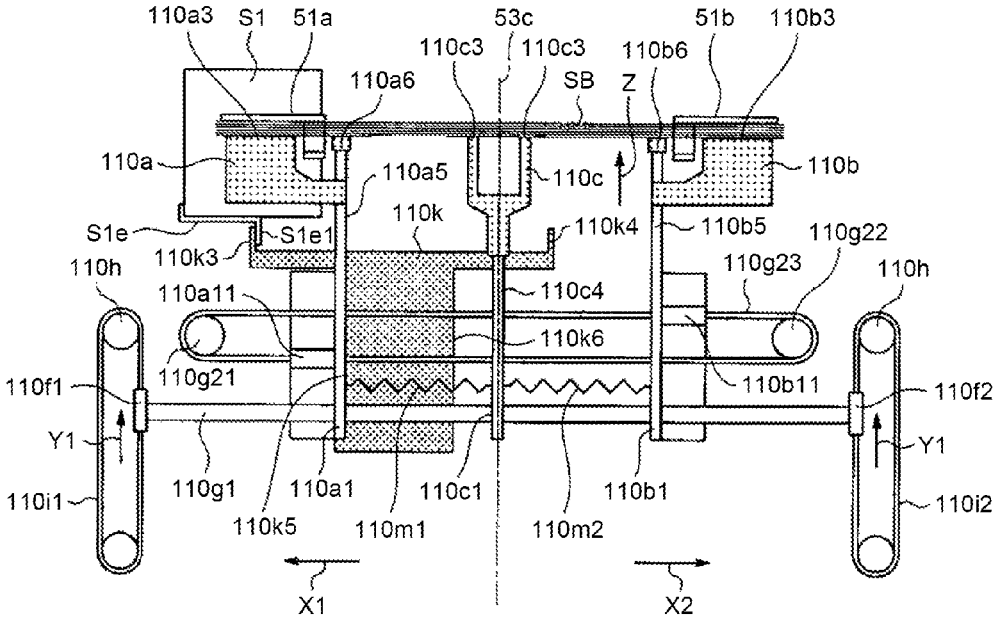
FIG. 15 is an operation explanatory view illustrating a relationship upon front binding between the end surface binding stapler, first to third pressing members, and the trailing end reference fence.

Coupling portions 110*a*11 and 110*b*11 of the first slider portion 110*a*1 and the second slider portion 110*b*1 are respectively coupled to one side and the other side of the timing belt 110*g*23 at symmetrical positions about the base 110*c*1 of the third pressing member 110*c* (refer to FIG. 15). Moreover, between the first and third pressing members 110*a* and 110*c* and between the second and third pressing members 110*b* and 110*c* are elastic members (e.g., tension coil springs) 110*m*1 and 110*m*2 that always elastically bias in a direction bringing the two close to each other, respectively (refer to FIG. 15). Consequently, the first and second pressing members 110*a* and 110*b* are brought close to and separated from each other, symmetrically about the third pressing member 110*c*, in response to the rotation of the timing belt 110*g*23.

Pulleys 110*h* are respectively arranged on the sides of the first and second sliders 110*f*1 and 110*f*2. First and second timing belts 110*i*1 and 110*i*2 extend between the paired pulleys 110*h*, parallel with the first and second sliders 110*f*1 and 110*f*2. Moreover, other pulleys 110*h*1 and 110*h*2 are provided coaxially with drive shafts of the pulleys 110*h* arranged on a side away from a side where the trailing end reference fence 51 of the support member 110*d* is arranged. A third timing belt 110*i*3 extends between the pulleys 110*h*1 and 110*h*2 parallel with the second guide shafts 110*g*1 (refer to FIG. 13). Furthermore, a drive motor 110*j* that drives one of the pulleys 110*h* arranged on a side where the second slider 110*f*2 is arranged is provided on the arranged side. A fourth timing belt 110*i*4 extending between a drive pulley 110*j*1 of the drive motor 110*j* and the one of the pulleys 110*h* transmits a driving force. Consequently, a driving force of the drive motor 110*j* is transmitted from the fourth timing belt 110*i*4 to the first and second sliders 110*f*1 and 110*f*2, which enables the first and second sliders 110*f*1 and 110*f*2 to reciprocate in a vertical direction relative to the sheet surface. The first to third pressing members 110*a*, 110*b* and 110*c* become possible to perform a press/separation operation on the sheet bundle SB in response to the reciprocation in a state where the first and second pressing members 110*a* and 110*b* can move in the width direction of the sheet surface.

The first to third pressing members 110*a*, 110*b* and 110*c* are supported by their respective slider portions 110*a*1, 110*b*1, and 110*c*1 in a state of being always elastically biased by elastic members (e.g., tension coil springs) 110*a*2, 110*b*2, and 110*c*2 toward a direction to elastically bias the pressing portion side to the sheet surface. FIG. 9 illustrates an initial state of no-stacked, and FIG. 10 illustrates a stacked state where the sheet bundle SB is being pressed, respectively. In a no-stacked state, the first and second sliders 110*f*1 and 110*f*2 move away from the sheet surface, and are separated to the maximum extent possible. In a stacked state, the first and second sliders 110*f*1 and 110*f*2 advance to the maximum extent possible, and the elastic members 110*a*2, 110*b*2, and 110*c*2 are compressed. If the sheet bundle SB is pressed in this manner, pressing forces act on the sheet surface from the elastic members 110*a*2, 110*b*2 and 110*c*2.

The first to third pressing members 110*a*, 110*b* and 110*c* include pressing portions 110*a*3, 110*b*3 and 110*c*3 that directly press the sheet surface, support portions 110*a*4, 110*b*4 and 110*c*4 that support the pressing portions 110*a*3,

110*b*3 and 110*c*3, and support shafts 110*a*5, 110*b*5 and 110*c*5 that are integrally coupled to the support portions 110*a*4, 110*b*4 and 110*c*4. The elastic members 110*a*2, 110*b*2 and 110*c*2 are attached to the support shafts 110*a*5, 110*b*5 and 110*c*5. The support portions 110*a*4, 110*b*4 and 110*c*4 are pressed by elastic forces against the sheet surface side.

The pressing portion 110*c*3 of the third pressing member 110*c* is configured to bifurcate when viewed from the arrow A direction to allow the release claws 52*a* to pass through a bifurcated space portion 110*c*41. The pressing portion 110*c*3 of the third pressing member 110*c* does not interfere with the release claws 52*a*. Consequently, at the time when the pressing state on the sheet surface by the first to third pressing members 110*a*, 110*b* and 110*c* is cancelled, the release belt 52 is driven to enable the release claw 52*a* to push up the sheet bundle SB. Accordingly, latency up to the next job can be minimized. The center of the bifurcated space portion 110*c*41 in the sheet width direction corresponds to an alignment center 53*c* by the jogger fence 53 (refer to FIGS. 17A and 17B).

Moreover, at the center of the support member 110*d* is a guide groove 110*d*1 parallel with the second guide shafts 110*g*. The guide groove 110*d*1 is for sliding a sliding member 110*k* in the direction orthogonal to the sheet conveying direction. A base portion 110*k*1 of the sliding member 110*k* is loosely fit to the guide groove 110*d*1, and can move in the longitudinal direction of the guide groove 110*d*1.

Moreover, as illustrated in FIG. 14, a base 50*b* is coupled to a conveying-direction moving mechanism 55 of the trailing end reference fence 51, and can move by a driving force transmission mechanism 55*b* that is driven by a conveying-direction fence drive motor 55*a*, in the up and down direction within a predetermined area in the sheet conveying direction.

FIGS. 15, 16, and 17A and 17B are operation explanatory views illustrating relationships respectively upon front binding, upon rear binding, and upon two-point binding between the end surface binding stapler S1, the first to third pressing members 110*a*, 110*b* and 110*c*, and the trailing end reference fences 51*a* and 51*b*.

In the case of front binding, as illustrated in FIG. 15, the end surface binding stapler S1 moves to a binding position at the front of the apparatus (front binding position) by the stapler moving motor 159. At this point, as illustrated in FIG. 13, a surface at the front of the apparatus of a first contact portion S1e1 of a contact member S1e comes into contact with a first contacted portion 110*k*3 of the sliding member 110*k*. Following the movement, the sliding member 110*k* is moved to the front of the apparatus (an arrow X1 direction). The movement brings a contact surface 110*k*5 of the sliding member 110*k* into contact with a side surface of the support portion 110*a*4 of the first pressing member 110*a*. The first pressing member 110*a* also, as well as the sliding member 110*k*, moves to a position corresponding to the binding position of the end surface binding stapler S1 against an elastic biasing force of the elastic member 110*m*1. Moreover, the second pressing member 110*b* moves by the rotation of the timing belt 110*g*23 in a direction away from the first pressing member 110*a* (an arrow X2 direction), and is located at a symmetrical position to the first pressing member 110*a* about the third pressing member 110*c*. Moreover, a reference numeral 110*k*6 denotes a contact surface that comes into contact with a side surface of the support portion 110*b*4 of the second pressing member 110*b*.

In this state, the drive motor 110*j* is driven and the first and second sliders 110*f*1 and 110*f*2 move a predetermined distance in a direction to press the sheet bundle SB (the arrow Y1 direction: the same shall apply hereinafter). As a result, the pressing portions 110*a*3, 110*b*3 and 110*c*3 of the pressing members 110*a*, 110*b* and 110*c* come into contact with the sheet surface of the sheet bundle SB, and stop in a state of pressing at a predetermined pressure (an arrow Z direction: the same shall apply hereinafter). The pressing force is imparted by elastic forces of the elastic members (tension coil springs) 110*a*2, 110*b*2 and 110*c*2. The drawing illustrates a state where pressing portions 110*a*6 and 110*b*6 press the vicinity of the biding position to hold the sheet bundle SB.

Figure 16:
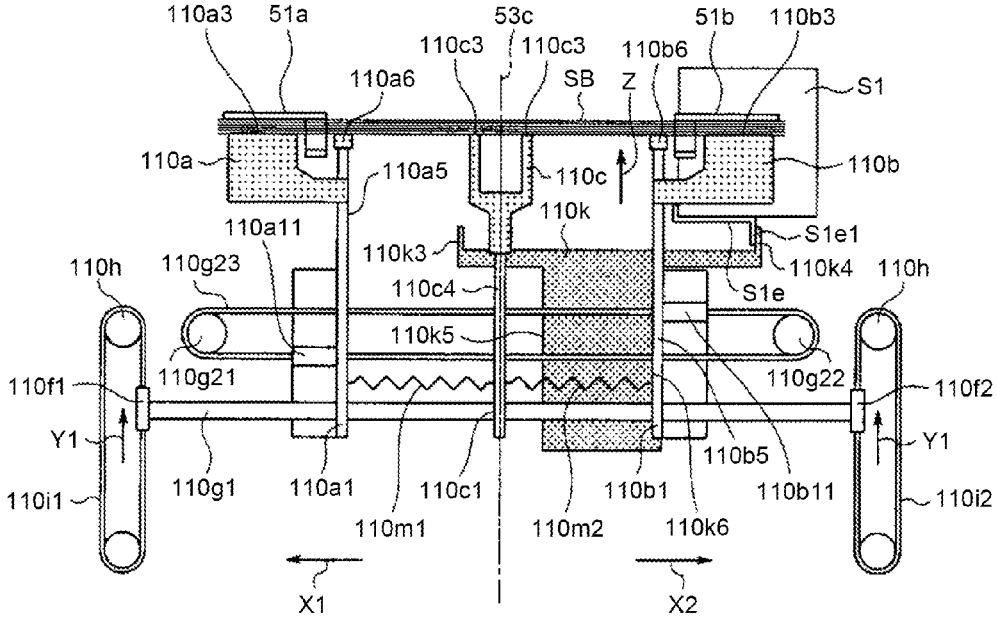
FIG. 16 is an operation explanatory view illustrating a relationship upon rear binding between the end surface binding stapler, the first to third pressing members, and the trailing end reference fence.

FIG. 16 is an example of rear binding, and the end surface binding stapler S1 moves to the binding position at the rear of the apparatus (the rear binding position). At this point, a surface at the rear of the apparatus of the contact portion S1e1 of the contact member S1e comes into contact with a second contacted portion 110*k*4 of the sliding member 110*k*. Following the movement, the sliding member 110*k* is moved to the rear side of the apparatus (an arrow X2 direction).

Figure 17A:
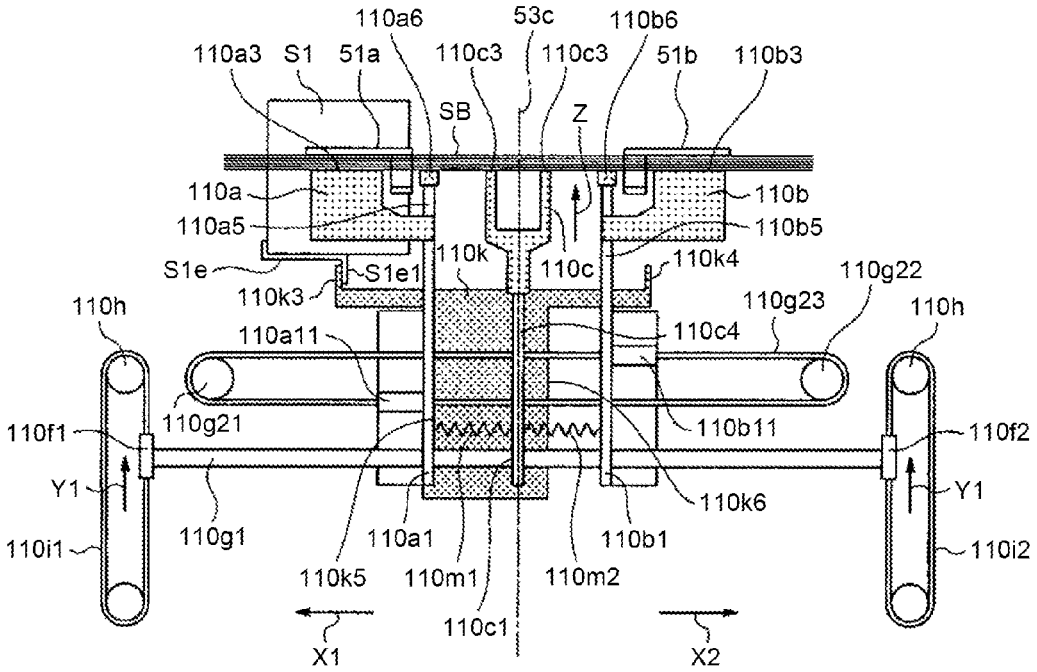
FIGS. 17A and 17B are operation explanatory views illustrating a relationship upon two-point binding between the end surface binding stapler, the first to third pressing members, and the trailing end reference fence.
Figure 17B:
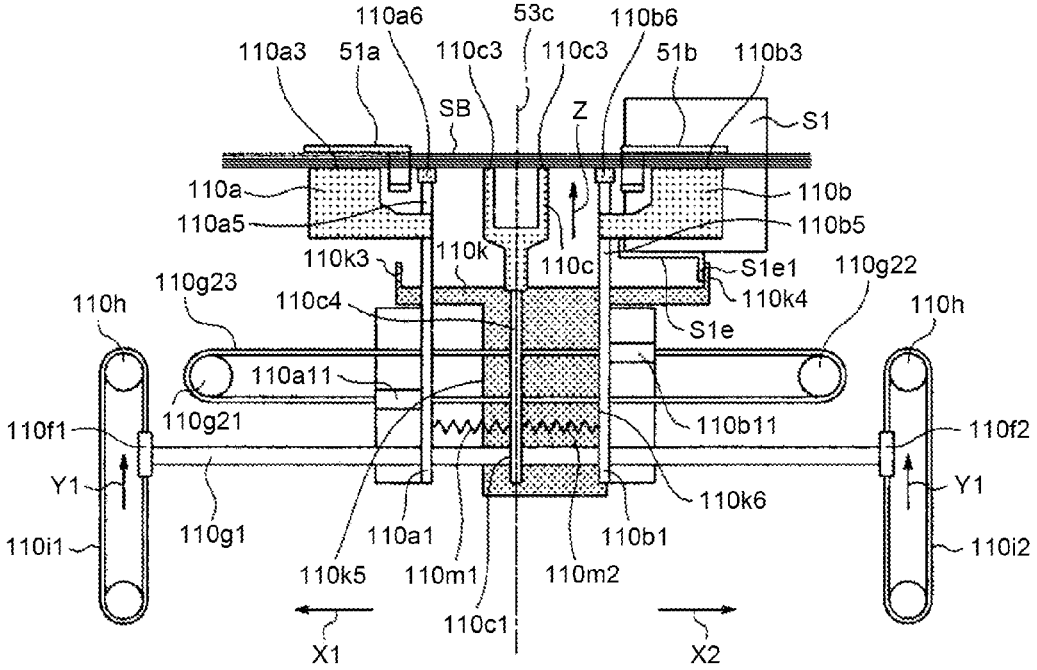

In the case of two-point binding, only the binding positions are different. As illustrated in FIGS. 17A and 17B, the operation is the same as those of front biding and rear binding. The binding positions are positions close to the center of the sheet bundle SB in the width direction, and are set to positions symmetrical about the alignment center 53*c* (the center of the aligned sheet bundle SB in the width direction). In other words, the operation itself is the same in the front binding illustrated in FIG. 17A as front binding that has been described with reference to FIG. 15, with an only difference in the distance from the alignment center 53*c*. After the operation, the end surface binding stapler S1 moves to the rear, and the rear binding illustrated in FIG. 17B is performed. The rear binding is also the same as the rear binding that has been described with reference to FIG. 16, with an only difference in the distance from the alignment center 53*c*. In the cases of front binding, rear binding, and two-point binding, the binding positions are set by controlling a motor driver of the stapler moving motor 159 by a CPU_PD1 of a control circuit to be described later.

Figure 18:
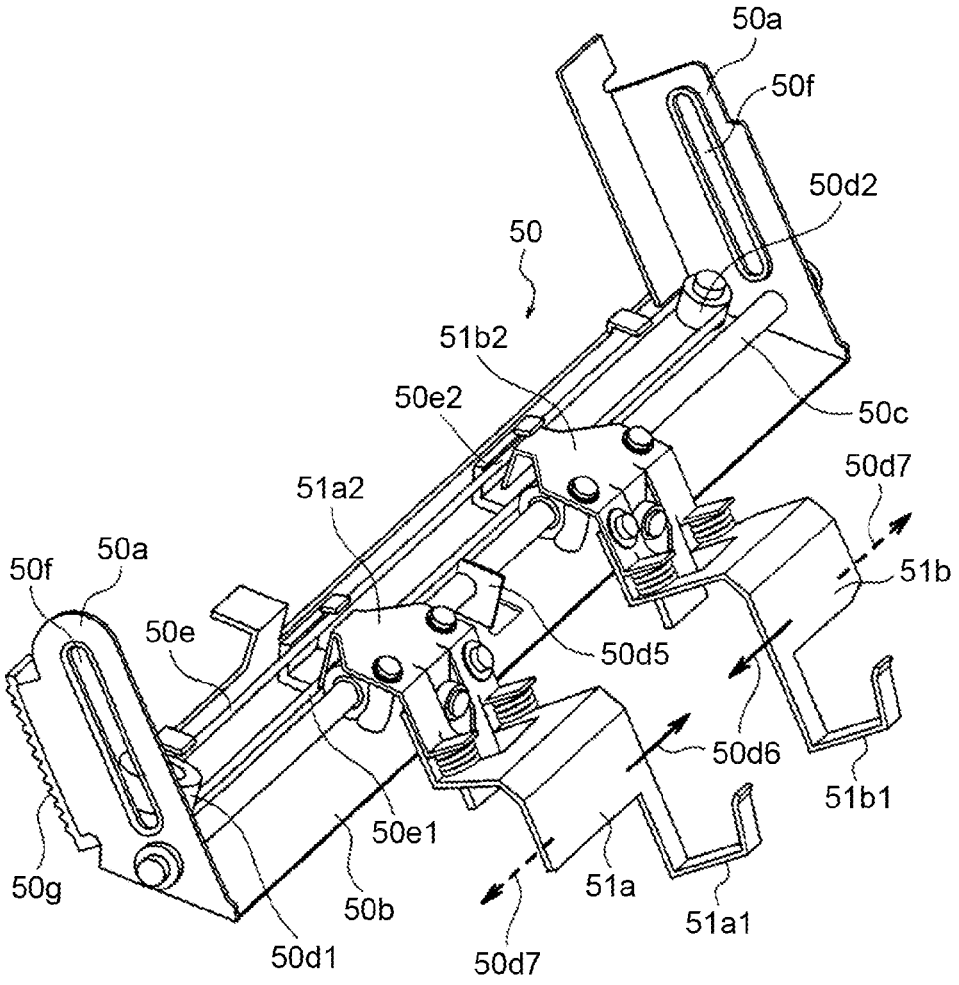
FIG. 18 is a perspective view illustrating a moving mechanism of the trailing end reference fence in a direction orthogonal to a sheet conveying direction.
Figure 19:
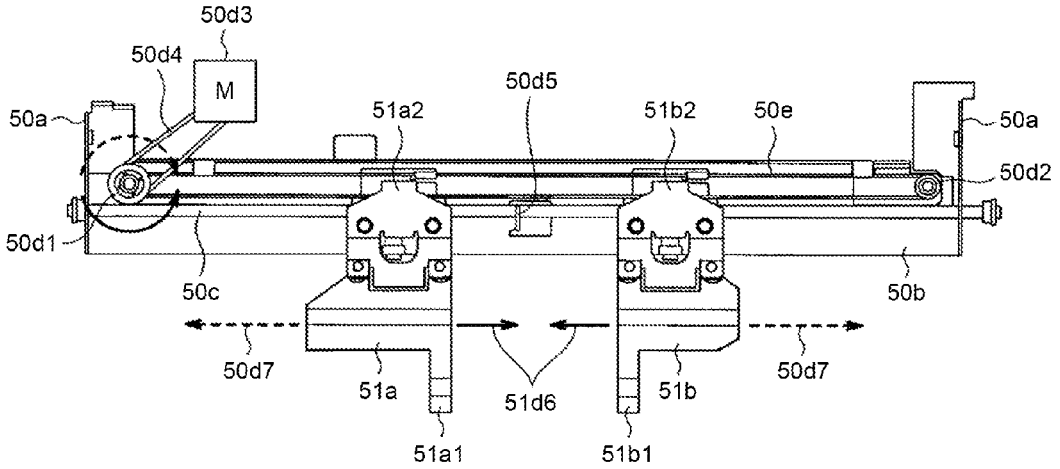
FIG. 19 is a side view of FIG. 18.

FIG. 18 is a perspective view illustrating a moving mechanism (hereinafter referred to as a width-direction moving mechanism) 50 of the trailing end reference fence in the direction orthogonal to the sheet conveying direction. FIG. 19 is its side view.

In these drawings, the width-direction moving mechanism 50 of the trailing end reference fence includes the base 50*b*, a slide shaft 50*c*, a timing belt 50*e* and a width-direction fence drive motor 50*d*3. Side plates 50*a* are provided in a standing manner on both sides of the base 50*b*. The slide shaft 50*c* is supported and fixed between both side plates 50*a*, and slidably supports support portions 51*a*2 and 51*b*2 of the trailing end reference fences 51*a* and 51*b*. The timing belt 50*e* extends between timing pulleys 50*d*1 and 50*d*2 on drive and driven sides, parallel with the slide shaft 50*c*, and is rotated and driven by driving the timing pulley 50*d*1 on the drive side by the width-direction fence drive motor 50*d*3 via a drive pulley 50*d*4.

In the width-direction moving mechanism 50, the support portion 51*a*2 of the trailing end reference fence 51*a* is attached to one side 50*e*1 of the parallel timing belt 50*e*, and the support portion 51*b*2 of the trailing end reference fence 51*b* to the other side 50*e*2 of the timing belt 50*e*, symmetrically about a width-direction center 50*d*5 in the center of the width direction. Consequently, for example, if the timing belt 50*e* rotates rightward, they approach the width-direction center 50*d*5 (an arrow 50*d*6 direction) symmetrically. If the timing belt 50*e* rotates leftward, they are symmetrically separated from the width-direction center 50*d*5 (an arrow 50*d*7 direction). As a result, the positions of the stacking surfaces 51*a*1 and 51*b*1 and the distance between them can be set by the rotation amount of the fence drive motor 50*d*3. Therefore, a stepping motor, for example, is used for the width-direction fence drive motor 50*d*3, considering the ease and accuracy of control.

Figure 20:
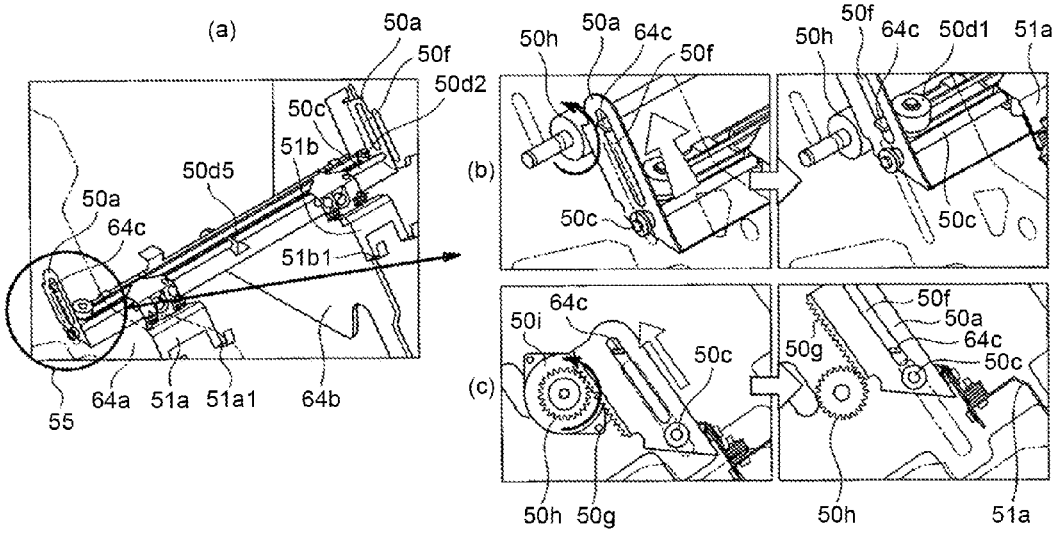
FIG. 20 is an explanatory view illustrating the moving mechanism of the trailing end reference fence in the sheet conveying direction, and its operation.
Figure 21:
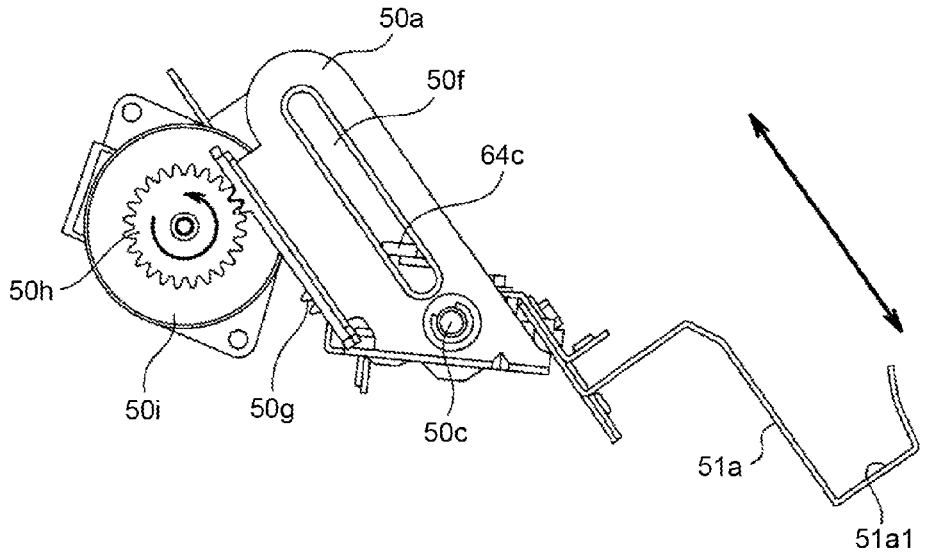
FIG. 21 is a main unit front view illustrating only mechanical units of the moving mechanism.
Figure 22:
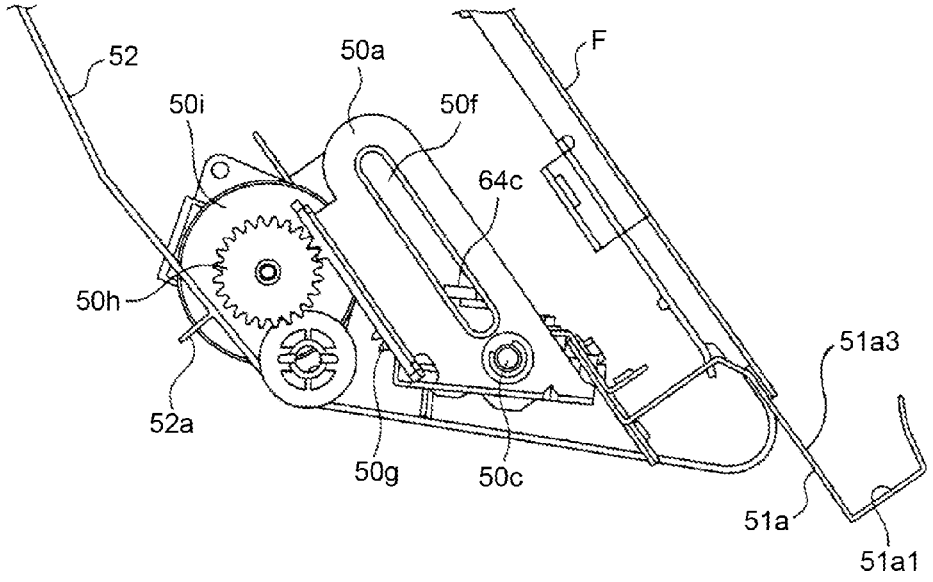
FIG. 22 is a main unit front view illustrating a state where the end surface binding processing tray and the release belt are added to the mechanical units of FIG. 21.
Figure 23:
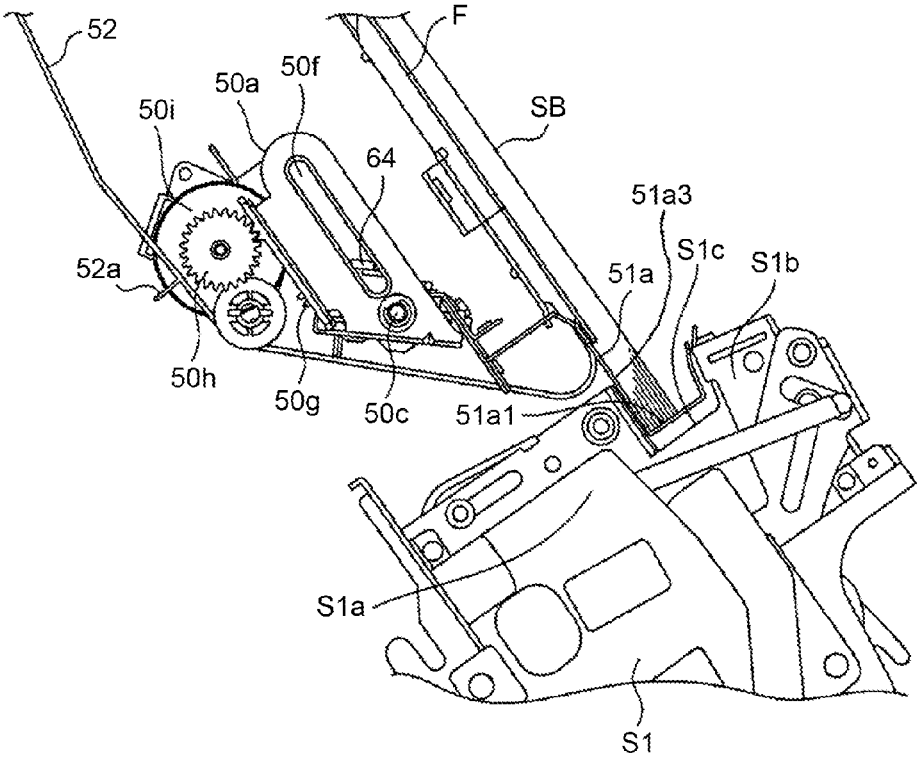
FIG. 23 is a main unit front view illustrating a relationship between the mechanical units of FIG. 21 and the end surface binding stapler, and illustrates a state where a sheet bundle is stacked into the trailing end reference fence.

FIG. 20 is an explanatory view illustrating the moving mechanism (hereinafter referred to as the conveying-direction moving mechanism) 55 of the trailing end reference fence 51 in the sheet conveying direction, and its operation. FIG. 21 is a main unit front view illustrating only mechanical units of the moving mechanism. FIG. 22 is a main unit front view illustrating a state where the end surface binding processing tray and the release belt are added to the mechanical units of FIG. 21. FIG. 23 is a main unit front view illustrating a relationship between the mechanical units of FIG. 22 and the end surface binding stapler, and illustrates a state where a sheet bundle is stacked into the trailing end reference fence.

In these drawings, the conveying-direction moving mechanism 55 of the trailing end reference fence 51 includes slide grooves 50*f*, protruding members 64*c*, a rack 50*g*, a pinion 50*h*, and a conveying-direction fence drive motor 50*i*. The slide grooves 50*f* are formed, parallel with a bottom plate of the end surface binding processing tray F, on the pair of side plates 50*a* provided in a standing manner to the base 50*b*. The protruding members 64*c* are provided in a standing manner from the front side plate 64*a* and the rear side plate 64*b*, are loosely fit to the slide grooves 50*f*, regulate the moving positions of the side plates 50*a*, and permit only the movement in a direction parallel to the bottom plate of the end surface binding process tray F. The movement is performed by the pinion 50*h* to which a driving force is transmitted from a rotation shaft of the conveying-direction fence drive motor 50*i*, and the rack 50*g* provided on an end surface of one of the side plates 50*a*, the rack 50*g* engaging with the pinion 50*h*. In a case of the embodiment, it is possible to set a position at an arbitrary position between an initial position (the lowest position) illustrated in (a) of FIG. 20 and a maximum drive position (the highest position) illustrated in (c) of FIG. 20, by the rotation amount of the conveying-direction fence drive motor 50*i*. In the embodiment, a stepping motor is used also for the conveying-direction fence drive motor 50*i* for ease of control and accuracy of a position.

When the binding position in the conveying direction and the binding position in the width direction are set, the end surface binding stapler S1 is moved to the binding position as illustrated in FIG. 23. The staple S1d is projected from the stitcher S1a side to the sheet bundle SB side. The clincher S1b is operated to bend the tips of the staple S1d and bind the sheet bundle SB. When the binding process ends, the end surface binding stapler S1 returns to the home position to wait for the next operation. The sheet bundle SB is discharged by the release claw 52*a* from the end surface binding stapler F by the rotation operation of the release belt 52.

In this manner, the positions of the sheet width and conveying directions of the trailing end reference fences 51*a* and 51*b* are respectively set by the fence drive motor 50*d*3 and the conveying-direction fence motor 50*i*. The position of the sheet S in the width direction is changed by the sheet size and the stapling position in the width direction. The position of the sheet S in the conveying direction is changed in accordance with the set amount of the binding position from the sheet trailing end ST. The conveying-direction moving mechanism 55 is not a unit whose operation is often required and therefore is preferably configured to include, for example, a worm gear that cannot be back-driven, or to make necessary power to the minimum by providing a mechanical holding mechanism.

Figure 24:
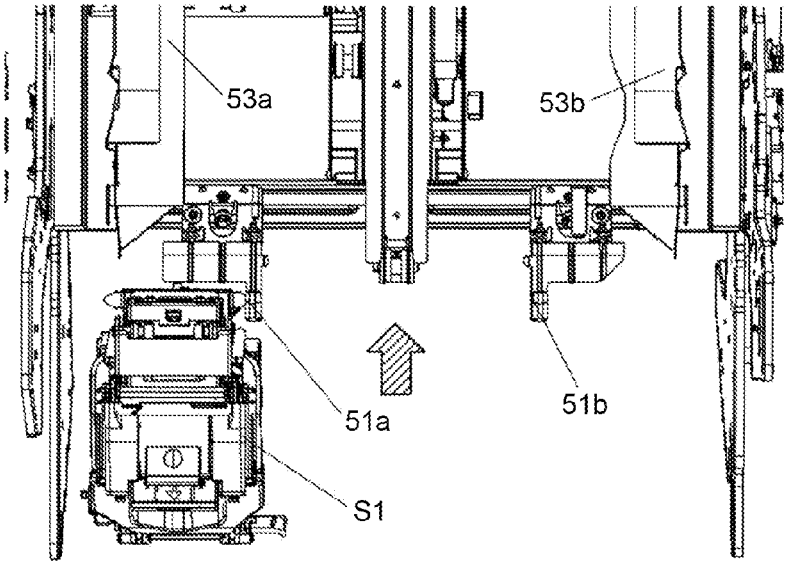
FIG. 24 is a view when viewing around the stapler from a vertical direction of the surface of sheets stacked on the end surface binding processing tray.

FIG. 24 is a view when viewing around the stapler from a vertical direction of the surface of sheets stacked on the end surface binding processing tray F. As described above, the sheets S are supported by the two front and rear trailing end reference fences 51*a* and 51*b*, and are aligned in the vertical direction while being aligned by the two front and rear jogger fences 53*a* and 53*b* in the width direction. FIGS. 25A and 25B, and 26A and 26B are schematic drawings when viewed from an arrow direction in FIG. 24 (a direction of a lower end of paper).

Figure 25A:
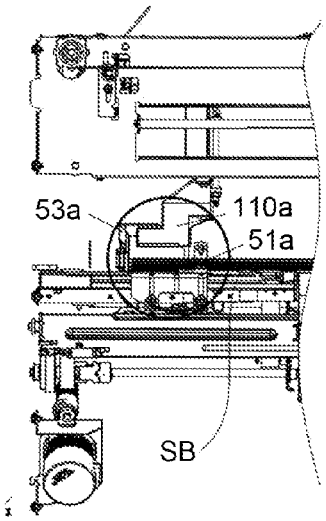
FIGS. 25A and 25B are schematic drawings when viewed from a direction of a lower end of paper in FIG. 24, and illustrates a state where sheets having no curl are stacked.
Figure 25B:
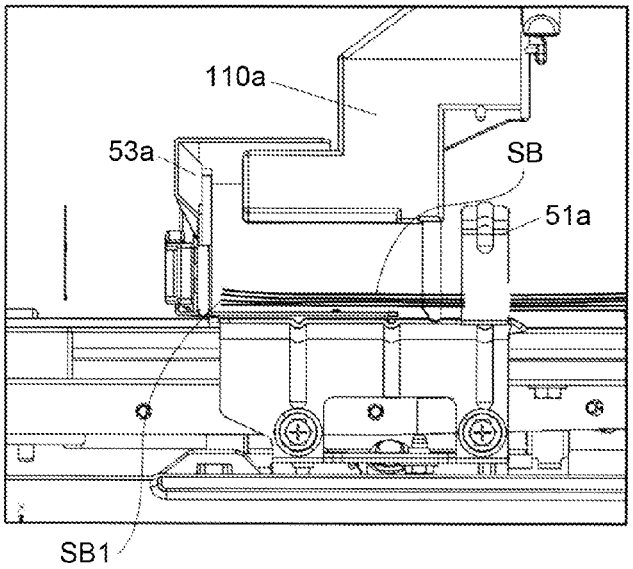
Figure 26A:
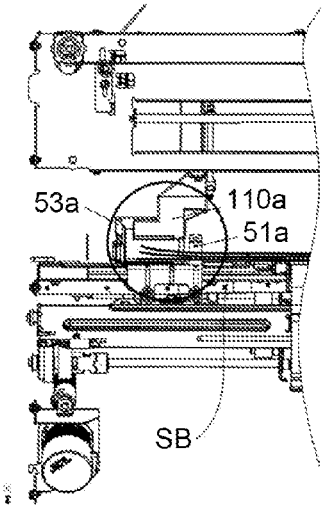
FIGS. 26A and 26B are schematic drawings when viewed from the direction of the lower end of paper in FIG. 24, and illustrate a state where curled sheets are stacked.
Figure 26B:
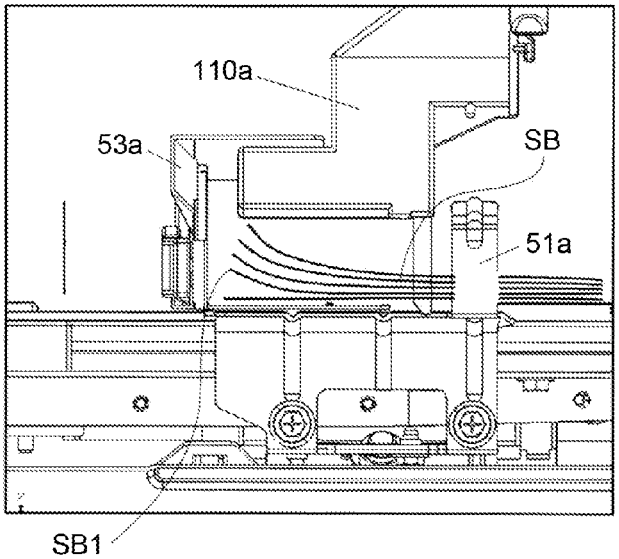

FIGS. 25A and 25B illustrate a state where the sheets S having no curl are stacked. FIG. 25A illustrates main units at the front, and FIG. 25B is a main unit enlarged view further enlarging and illustrating an alignment unit of sheets, the unit being encircled in FIG. 25A. Moreover, FIGS. 26A and 26B illustrate a state where the curled sheets S are stacked. FIG. 26A illustrates main units at the front, and FIG. 26B is a main unit enlarged view further enlarging and illustrating the alignment unit of sheets, the unit being encircled in FIG. 26A.

As illustrated in FIGS. 25A and 25B, if the sheets S constituting the sheet bundle SB have no curl, and an end SB1 of the sheet bundle SB is not curling up or bulging, alignment in the width direction is performed by the jogger fences 53*a* and 53*b* to regulate the side surfaces of the sheet S or sheet bundle SB by the jogger fences 53*a* and 53*b*. Unevenness of the sheets S is straightened to align the sheets S.

However, if the sheets S are curled as in FIGS. 26A and 26B, the end SB1 of the sheet bundle SB curls up and bulges. Therefore, even if the jogger fences 53*a* and 53*b* perform alignment on the width direction in this state, it is not possible to uniquely regulate the end SB1 of the sheet S or sheet bundle SB as illustrated in FIG. 26B. Naturally, it is impossible to straighten unevenness of the sheet bundle SB.

Hence, in the embodiment, the end SB1 of the sheet bundle SB is pressed in the sheet thickness direction to regulate the curl and bulge of the end SB1 of the sheet S or sheet bundle SB and concurrently perform the alignment operation on the end SB1 of the sheet S or sheet bundle SB by the jogger fence 53. Consequently, upon alignment, the jogger fence 53 reliably abuts the end SB1 of the sheet S or sheet bundle SB. Accordingly, it is possible to straighten unevenness of the end SB1 of the sheet S or sheet bundle SB. In this manner, the alignment operation is concurrently performed in parallel with the press operation in the thickness direction of the sheet S or sheet bundle SB. In such parallel operations, the operation timings of both become an important factor.

Figure 27:
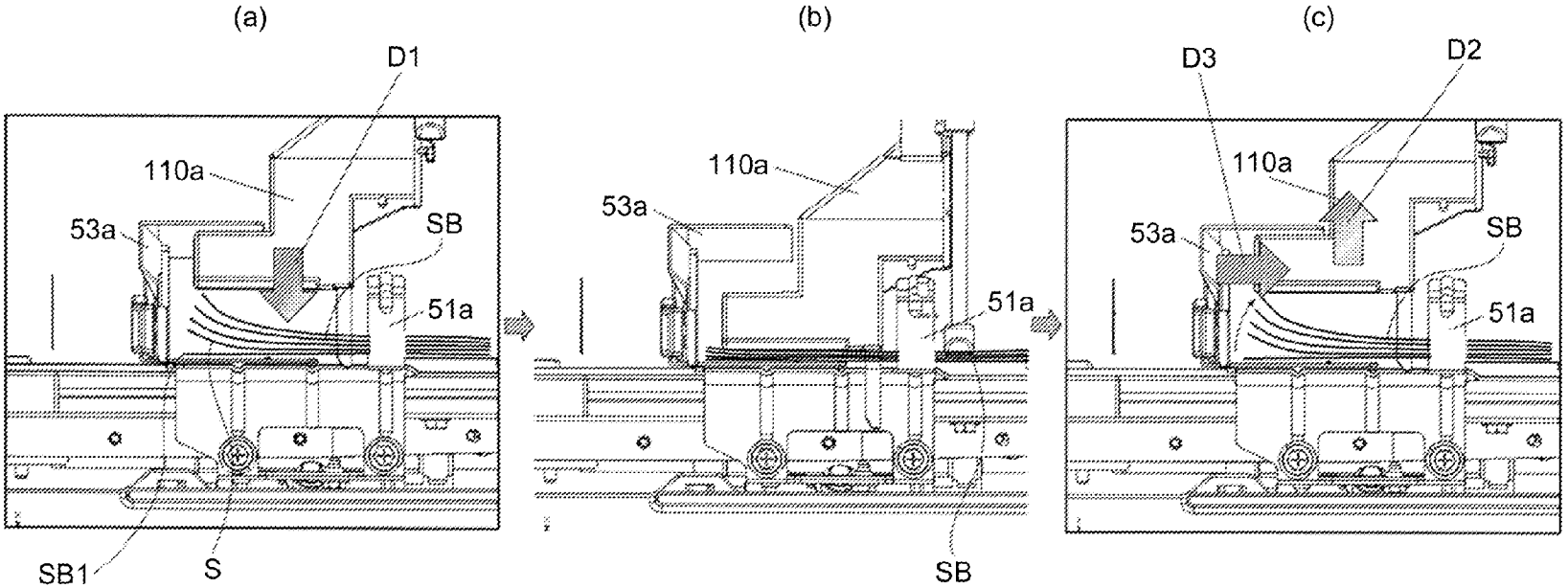
FIG. 27 is an explanatory view illustrating a state of a sheet bungle when timing to press a sheet bundle by the pressing member is too early and a state of the sheet bundle when a press is cancelled.

FIG. 27 is an explanatory view illustrating a state of a sheet bundle when timing to press the sheet bundle by the pressing member is too early and a state of the sheet bundle when a press is cancelled. FIG. 27 is an example where before the jogger fence 53 abuts the end SB1 of the sheet bundle SB (state (a) of FIG. 27), the pressing member 110 (only the first pressing member 110*a* is illustrated in the drawings) starts the press operation on the sheet bundle SB (an arrow D1 direction), completes the press (state (b) of FIG. 27), and then cancels the press (state (c) of FIG. 27: an arrow D2 direction), and the end of the sheet bundle SB is subsequently squeezed in by the jogger fence 53. As can be seen from FIG. 27, in the case of such operation timings, when the sheet bundle SB is aligned by the jogger fence 53 after being pressed by the first pressing member 110*a*, the end SB1 of the sheet bundle SB curls up or bulges again and therefore it is not possible to align the sheet bundle SB.

Moreover, if the timing to press the sheet bundle SB by the pressing member 110*a* is later than the alignment operation of the jogger fence 53, when the jogger fence 53 squeezes the end SB1 of the sheet bundle SB in, there are already a curl and a bulge and accordingly it is not possible to align the end SB1. Even if the sheet bundle SB is pressed by the pressing member 110*a* in that state, alignment is not possible. In FIG. 27, only the front jogger fence 53*a*, first pressing member 110*a*, front trailing end reference fence 51*a* are illustrated. However, the rear jogger fence 53*b*, the second and third pressing members 110*b* and 110*c*, and the rear trailing end reference fence 51*b* are also operated in synchronization with this operation. The same shall apply hereinafter.

Figure 28:
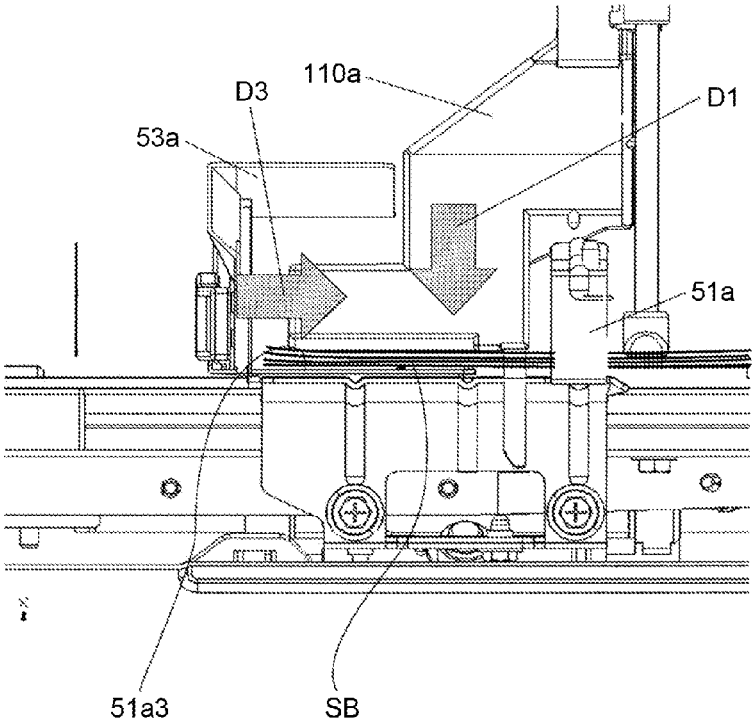
FIG. 28 is an explanatory view illustrating an alignment operation in the embodiment of the present invention, and is an example of concurrently performing the press operation and the alignment operation.

FIG. 28 is an explanatory view illustrating the alignment operation in the embodiment. The example of FIG. 28 is an example where the press operation of the sheet bundle SB by the pressing member 110 and the alignment operation of the sheet bundle SB by the jogger fence 53 are concurrently (at the same timing) performed in parallel. In other words, in this example, the end SB1 of the sheet bundle SB is squeezed in by the jogger fence 53 in an arrow D3 direction while the sheet bundle SB is pressed by the pressing member 110 in the arrow D1 direction.

At this point, if the sheet bundle SB is perfectly pressed against the end surface binding processing tray F side as in the case where the sheet bundle SB is bound by the pressing member 110, even if being squeezed in by the jogger fence 53 in the arrow D3 direction, the sheets S will not move. Accordingly, the sheet bundle SB cannot be aligned. Hence, the pressing force of the pressing member is set to a pressure that only allows the sheets S to move in the arrow D3 direction in accordance with the thickness of the sheet bundle SB (the number of stacked sheets S). Also in FIG. 28, only the first pressing member 110*a* is illustrated. However, the same shall apply to the second and third pressing members 110*b* and 110*c*.

Moreover, instead of the setting of the pressing force of the pressing member 110, it is also possible to set a space from a holding surface 51*a*3 (refer to FIGS. 22 and 23) on a side, with which the back of the sheet S comes into contact, of the trailing end reference fence 51 or the sheet stacking surface of the processing tray F. At this point, it is sufficient if the pressing surface of the pressing member 110 comes into light contact with the topmost surface of the sheet bundle SB, or if the space allows the sheets S to move without curling up or bulging when the sheets S are squeezed in by the jogger fence 53 even if the pressing surface is a little apart from the topmost surface.

In any case, the sheet bundle SB is aligned in a state where the pressing member 110 regulates the position of the topmost surface of the sheet bundle SB such that the sheets S can move by the squeezing operation of the jogger fence 53. At this point, it is arbitrary whether to set the pressing force or space.

In the embodiment, an appropriate pressing force or space is experimentally determined in advance, using the number of sheets to be bound, the thickness of sheets, the sheet size (sheet width and length) as variables. They are tabled to be stored in memory of a control device of the sheet postprocessing apparatus PD. Based on the number of sheets (the number of sheets to be bound) carried in, in addition to the information on the thickness of sheets and the sheet size (the sheet width and length) transmitted from the image forming apparatus PR side, the CPU_PD1, which is described later, selects an appropriate pressing force or space. The CPU_PD1 controls the back-and-forth movement of the pressing member 110 on the sheet bundle SB based on the selected pressing force or space, and thus can align the sheets S without curling up or bulging when the sheets S are squeezed in by the jogger fence 53.

Figure 29:
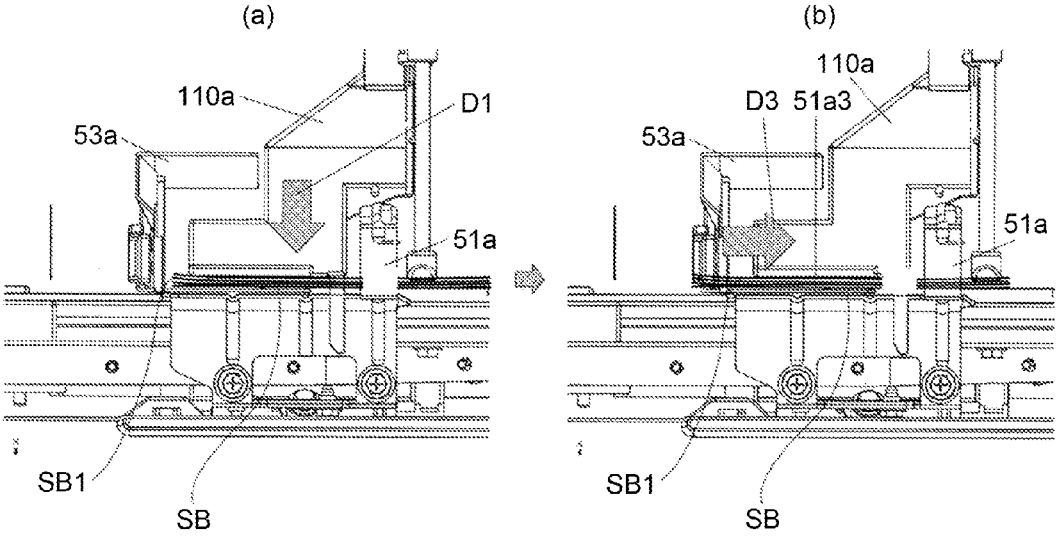
FIG. 29 is an explanatory view illustrating the alignment operation in the embodiment of the present invention, and are an example of performing the press operation first and performing the alignment operation under that state.

FIG. 29 is an explanatory view illustrating the alignment operation in the embodiment. The example of FIG. 29 is an example where the sheet bundle SB is aligned by the jogger fence 53 in a state where the sheet bundle SB is pressed by the pressing member 110. In other words, in this example, as illustrated in (a) of FIG. 29, the pressing member 110 presses the sheet bundle SB staked on the trailing end reference fence 51 and the processing tray F first against the holding surface 51*a*3 side of the trailing end reference fence 51 to prevent the sheets S from curling up or bulging. In this state, as illustrated in FIG. 29(*b*), the jogger fence 53 is moved to the sheet center side, and the end SB1 of the sheet bundle SB is squeezed in to be aligned.

The pressing force of the pressing member 110 to prevent the sheets S from curling up or bulging, or the space in between with the stacking surface 51*a*1 is as explained in the example illustrated in FIG. 28, and the setting of the pressing force or space in between with the holding surface 51*a*3 is also similar.

Also with regard to the alignment operation in the conveying direction performed by the tapping roller 12 and the trailing end reference fences 51*a* and 51*b*, from the same reason as the one described above, the alignment operation in the conveying direction is performed while the sheet bundle SB is being pressed in the thickness direction. Consequently, the alignment operation in the conveying direction is executed in a state where the curl and bulge of the trailing end of the sheet is straightened. Accordingly, it is possible to perform alignment in the conveying direction with reliability and accuracy.

Moreover, if the sheet S is wide in width or long in length in the conveying direction, or the sheet bundle SB has many sheets to be bound, the frictional resistance between sheets becomes large. Therefore, even if the sheets are squeezed in by the jogger fence 53 to the center side in the sheet conveying direction, the sheets are unlikely to move, which may result in a state of an alignment failure. In such a case, if the number of alignments where press by the pressing member 110, alignment in the width direction, and alignment in the conveying direction are regarded as a unit of alignment operations is increased, alignment accuracy can be improved.

With regard to the number of alignments for the sheet width, the sheet length and the number of sheets to be bound, an optimal number of alignments is experimentally determined in advance, using the sheet width, the sheet length and the number of sheets to be bound as variables, similarly to the pressing force or space of the pressing member 110. They are tabled to be stored in the memory of the control device of the sheet postprocessing apparatus PD. Based on the sheet width and length transmitted from the image forming apparatus PR side, and the accepted number of sheets (the number of sheets to be bound), the CPU_PD1, which is described later, selects an appropriate number of alignments, and repeats the alignment operation. In this case, it is also possible to further add the thickness of sheets as a variable.

Figure 30:
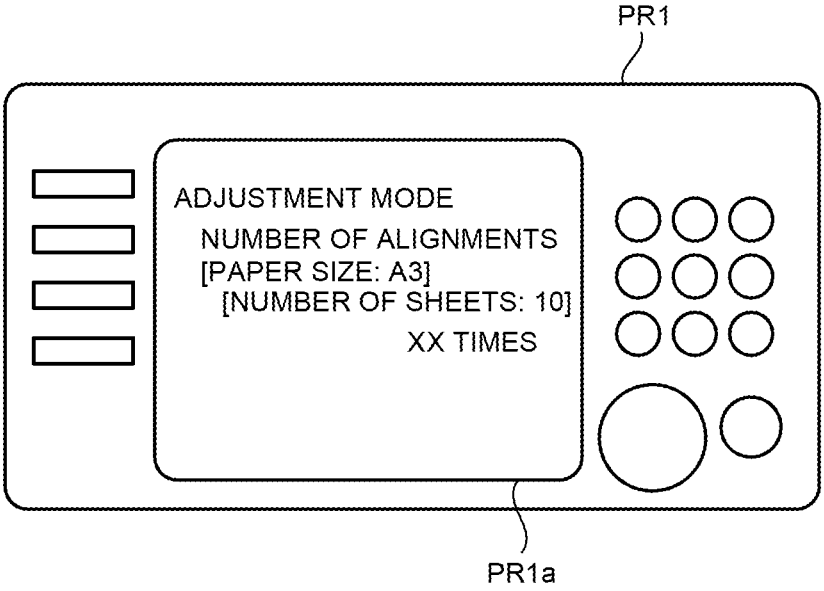
FIG. 30 is a front view of an operation panel for a user to set the number of alignments.

With regard to the number of alignments, a user also can instruct, input and set the number of alignments. In this case, it is arbitrarily set through an operation panel PR1 illustrated in FIG. 30, for example. In this example, the "adjustment mode," "number of alignments," "sheet size," and "number of sheets" are displayed on an operation display unit PR1a of the operation panel PR1. If the user inputs the number of alignments by input from a number key pad, the inputted number is displayed. Consequently, the user can set an appropriate number of alignments as appropriate by checking the sheet size and number of sheets, or the alignment state of the sheet bundle SB.

Figure 31:
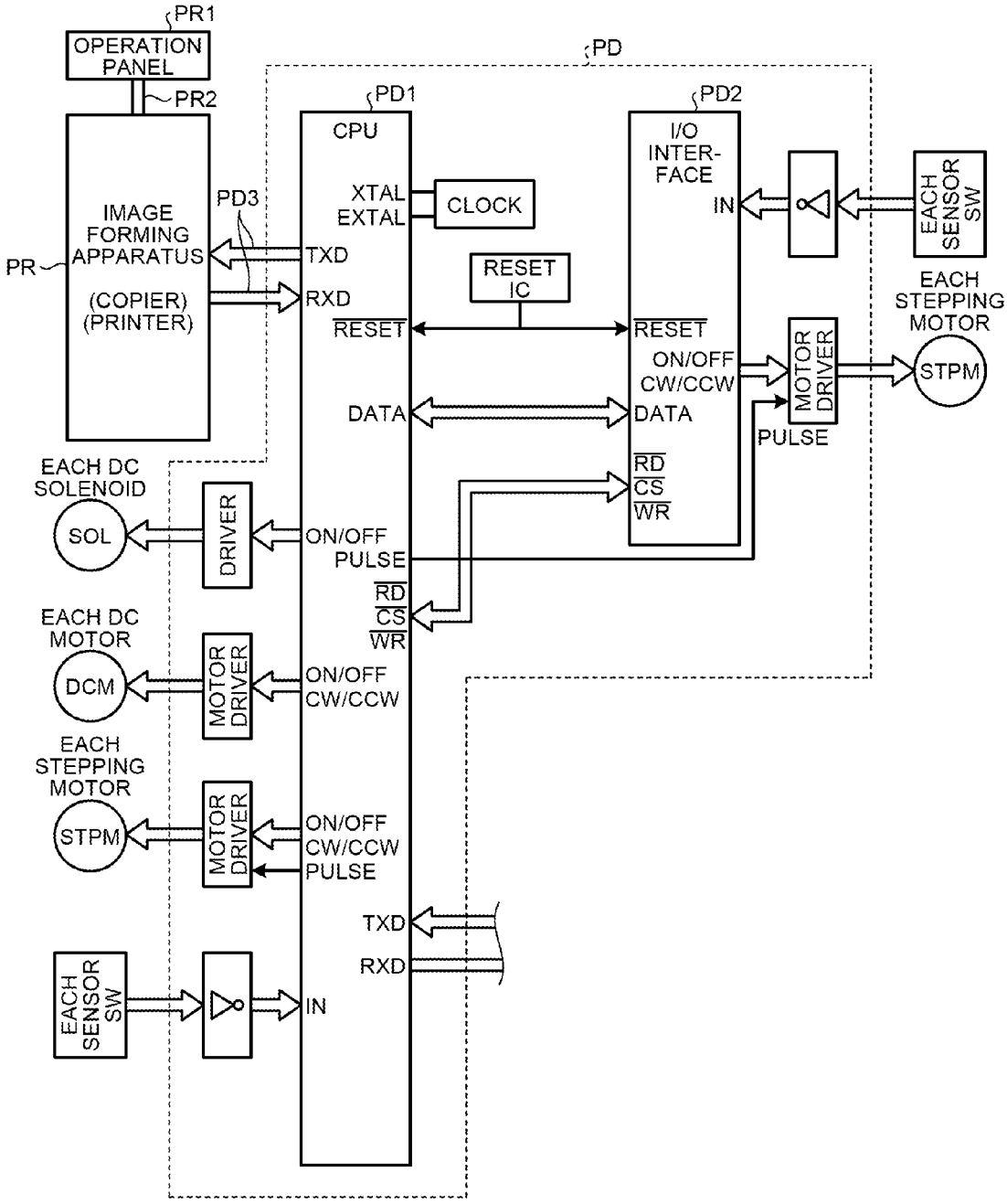
FIG. 31 is a block diagram illustrating a control configuration of an image forming system including the sheet postprocessing apparatus and the image forming apparatus.

FIG. 31 is a block diagram illustrating a control configuration of an image forming system including the sheet postprocessing apparatus PD and the image forming apparatus PR. The sheet postprocessing apparatus PD includes a control circuit on which a microcomputer having the CPU_PD1, an I/O interface PD2, and the like is mounted, signals from the CPU of the image forming apparatus PR or switches and the like of the operation panel PR1, and unillustrated sensors are inputted to the CPU_PD1 via a communication interface PD3. The CPU_PD1 executes predetermined control based on the inputted signal. Furthermore, the CPU_PD1 drives and controls solenoids and motors via drivers and motor drivers, and acquires sensor information in the apparatus from the interface. Moreover, the drive control of a motor is performed by a motor driver via the I/O interface PD2 in accordance with a control target or a sensor to acquire sensor information from the sensor. A program code stored in an unillustrated ROM is read by the CPU_PD1 to be deployed to an unillustrated RAM. The control is executed based on a program defined by the program code using the RAM as a work area and a data buffer. Moreover, although not illustrated, memory such as EPROM for holding data, or a large capacity storage device such as a hard disk device is mounted on the sheet postprocessing apparatus PD.

The control of the sheet postprocessing apparatus PD in FIG. 31 is executed based on an instruction or information from the CPU of the image forming apparatus PR. A user's operation instruction is given through the operation panel PR1 of the image forming apparatus PR. The image forming apparatus PR and the operation panel PR1 is connected to each other via the communication interface PR2. Consequently, an operation signal from the operation panel PR1 is transmitted from image forming apparatus PR to the sheet postprocessing apparatus PD, and a user or operator is informed of the process state and function of the sheet postprocessing apparatus PD via the operation panel PR1.

If it is constructed as an image forming system, it is also possible to configure the system such that the CPU of the image forming apparatus PR takes charge of the control function of the CPU_PD1 of the sheet postprocessing apparatus PD.

Figure 32:
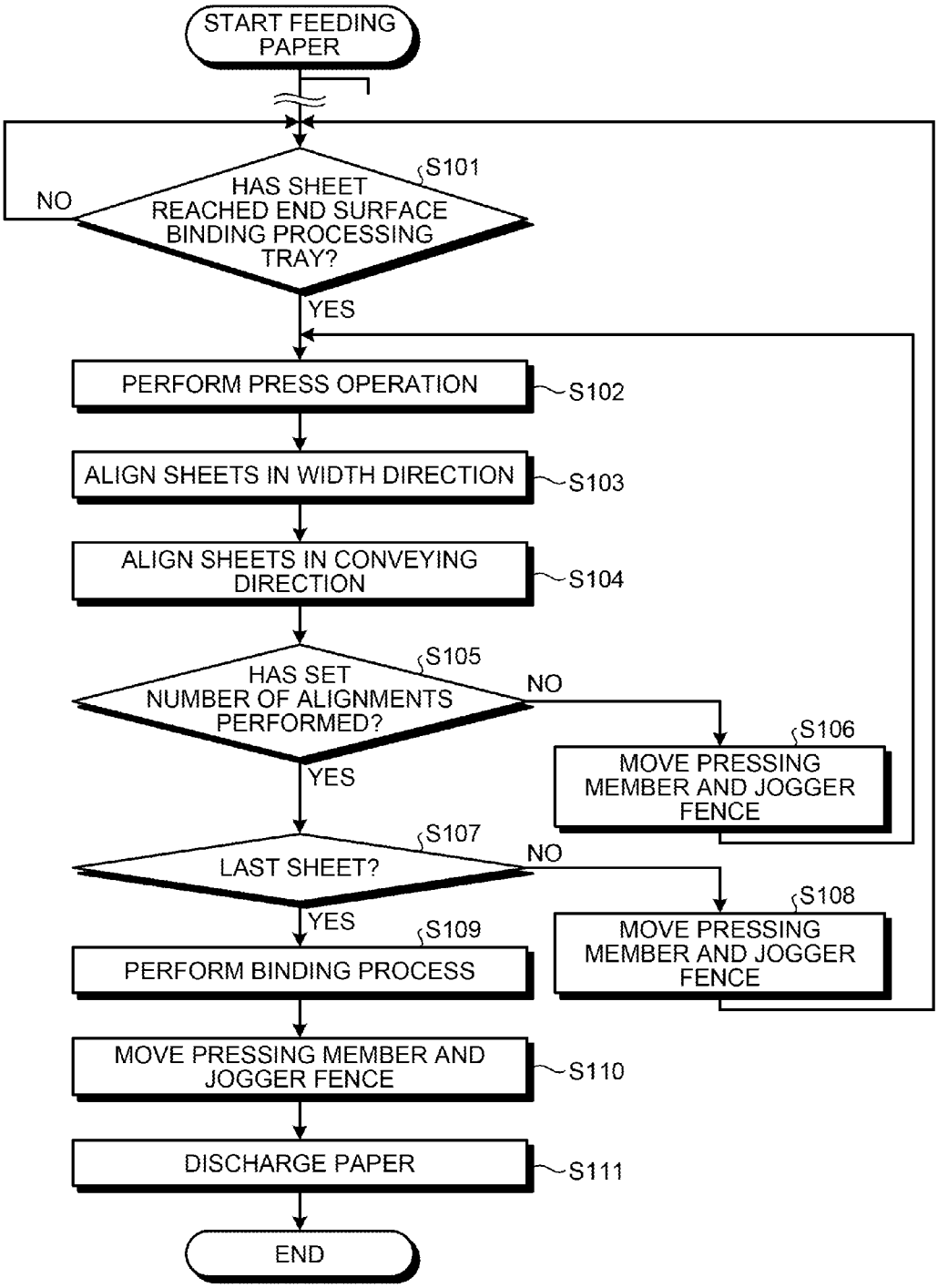
FIG. 32 is a flowchart illustrating a processing procedure when alignment in a width direction is performed first in selecting the number of alignments and performing the alignment operation a plurality of times.
Figure 33:
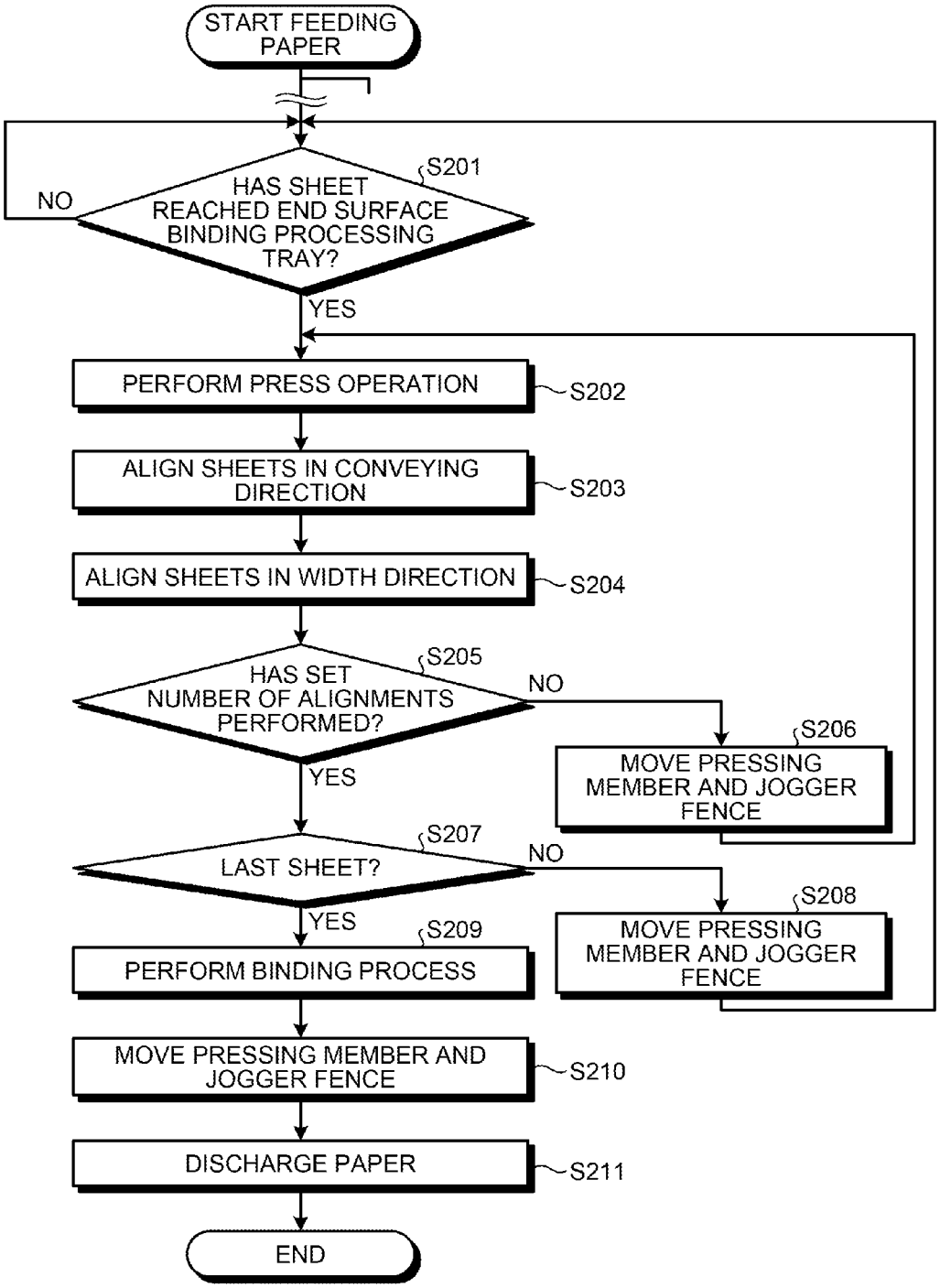
FIG. 33 is a flowchart illustrating a processing procedure when alignment in a conveying direction is performed first in selecting the number of alignments and performing the alignment operation a plurality of times.

FIGS. 32 and 33 are flowcharts illustrating process procedures when selecting the number of alignments and performing the alignment operations a plurality of times, which are executed by the CPU_PD1 of the sheet postprocessing apparatus PD.

In FIG. 32, a sheet starts to be fed to the sheet postprocessing apparatus PD. When a first sheet S reaches the end surface binding processing tray F (Step S101), the pressing member 110 performs the press operation on the sheet S (Step S102). The alignment operation in the width direction is performed by the jogger fence 53 in the state where the sheet S is being pressed (Step S103). The operations in Steps S102 and S103 may be concurrent (parallel operations) as illustrated in FIG. 28, or alignment may be performed after press as illustrated in FIG. 29.

Next, the sheet is tapped and dropped by the tapping roller 12 to the trailing end reference fence 51 side, and the alignment operation in the sheet vertical direction (the sheet conveying direction) is executed (Step S104). After the alignment operations in the sheet width and vertical directions are performed in Steps S102 to S104, whether the set number of alignment operations is complete is checked (Step S105), and if not, the pressing member 110 and the jogger fence 53 are moved away from the alignment positions (Step S106). Returning to Step S102, the subsequent processes are repeated.

If the number of alignment operations, which has been set in Step S105, are complete (Step S105: Yes), the sheet that reached in Step S101 and was aligned this time is checked whether to be the last sheet (Step S107). If not, the pressing member 110 and the jogger fence 53 are moved away from the alignment position (Step S108). Returning to step S101, the subsequent processes are repeated. The second sheet, third sheet . . . are processed. If the alignment operation for the last sheet ends (Step S107: Yes), the binding process is performed by the end surface binding stapler S1 on the sheet bundle SB.

When the sheet bundle SB is bound, the pressing member 110 and the jogger fence 53 are moved away from the alignment position (Step S110). The sheet bundle SB is discharged from the end surface binding processing tray F (Step S111), and the process ends.

The number of alignments in Step S105 has been set, regarding Steps S102, S103 and S104 as a unit of one alignment operation. The number is set and counted in this unit. The setting and count are performed by the CPU_PD1.

FIG. 33 is an example where the order of the alignment operation in the width direction of Step S103 and the alignment operation in the conveying direction of Step S104 is reversely illustrated in Steps S203 and S204 compared with the flowchart of FIG. 32. The process in Step S101 corresponds to that in Step S201, and the processes in Steps S105 to S111 to those in Steps S205 to S211. Therefore, the overlapping explanations will be omitted. The number of alignments in Step S205 is also similar to that in Step S105.

In this flowchart, when a first sheet S reaches the end surface binding processing tray F in Step S201, the pressing member 110 performs the press operation on the sheet S (Step S202). The sheet S is tapped and dropped by the tapping roller 12 to the trailing end reference fence 51 side in a state where the sheet S is pressed in the state, and the alignment operation in the sheet vertical direction (sheet conveying direction) is executed (Step S203). Next, the alignment operation in the width direction is executed by the jogger fence 53 (Step S204). The operations of Steps S202 to S204 may be concurrent (parallel operations), or alignment may be performed after press by the pressing member 110.

As described above, the embodiment takes the following effects.

(1) The sheet postprocessing apparatus PD includes the end surface binding processing tray F on which the sheet S conveyed thereto is stacked; the trailing end reference fence 51 and the tapping roller 12, which align the sheet S or sheet bundle SB stacked into the end surface binding processing tray F in the sheet conveying direction; the jogger fence 53 that aligns the sheet S or sheet bundle SB stacked into the end surface binding processing tray F in the direction orthogonal to the sheet conveying direction; the pressing member 110 that presses the sheet bundle SB at the end portion thereof on a predetermined one side, and the CPU_PD1 that causes the trailing end reference fence 51 and the tapping roller 12 and/or the alignment operation by the jogger fence 53 to execute an alignment operation during the press operation of the sheet S or sheet bundle SB performed by the pressing member 110. Accordingly, even if a curl or bulge occurs on the sheet bundle, alignment in the sheet conveying direction and the direction orthogonal to the sheet conveying direction can be reliably performed. In other words, upon alignment, the sheet bundle SB is pressed by the pressing member 110. Accordingly, a curl and a bulge do not occur at the end of the sheet bundle, and it is possible to ensure contact with the end of the sheet and move. As a result, it is possible to obtain excellent alignment accuracy.

"And/or" in the alignment operation by the trailing end fence 51 and the tapping roller 12 and/or the alignment operation by the jogger fence 53 indicates that there are cases where the alignment operation by the trailing end fence 51 and the tapping roller 12 and/or the alignment operation by the jogger fence 53, and the alignment operation by the jogger fence 53 are performed together, and where either the alignment operation by the trailing end fence 51 and the tapping roller 12 or the alignment operation by the jogger fence 53 is performed.

(2) The alignment operation by the trailing end fence 51 and the tapping roller 12 and/or the alignment operation by the jogger fence 53 are performed in parallel with the press operation performed by the pressing member 110. Accordingly, when the alignment operation is performed, even if a curl, a bulge and the like occurred on the sheet bundle, the sheet bundle is in a state of having been straightened by the press operation of the pressing member 110. The alignment operation is then performed in this state. Accordingly, it becomes possible to reliably align the sheet bundle and excellent alignment accuracy can be obtained.

(3) The press operation performed by the pressing member 110 is executed first, and then the alignment operation performed by the trailing end fence 51 and the tapping roller 12 and/or the alignment operation by the jogger fence 53 is/are subsequently performed in the pressed state. Accordingly, even if any alignment operation is performed, the sheet bundle SB is pressed first by the pressing member 110 to be in a state where the curl and bulge of the sheet bundle have been straightened. Hence, the alignment operation is reliably executed on the end of the sheet, and it is possible to obtain excellent alignment accuracy.

(4) The sheet postprocessing apparatus PD further includes the end surface binding stapler S1 that binds the aligned sheet bundle SB. The pressing member 110 presses the end of the sheet bundle SB on a side to be bound by the end surface binding stapler S1. Accordingly, when the sheet bundle SB is bound, it is possible to obtain excellent alignment accuracy and excellent binding accuracy.

(5) The end surface binding stapler S1 moves in the direction orthogonal to the sheet conveying direction. The pressing member 110 moves in the same direction in synchronization with the moving operation of the end surface binding stapler S1. Accordingly, the binding position and the press position are not inconsistent, and it is possible to obtain excellent binding accuracy.

(6) The alignment operation by the trailing end fence 51 and the tapping roller 12 and the alignment operation by the jogger fence 53 are set as a unit of one alignment operation. The number of units of alignment operations is set by the CPU_PD1. At this point, the CPU_PD1 changes the number of units of alignment operations in accordance with the sheet size or number of sheets to be bound. Accordingly, even in the cases of a sheet S being wide in width, a sheet S being long in the conveying direction, and a sheet bundle SB having many sheets to be bound, which have large frictional resistance between sheets, an alignment failure is not invited.

(7) The alignment operation by the trailing end fence 51 and the tapping roller 12 and the alignment operation by the jogger fence 53 are set as a unit of one alignment operation. The number of units of alignment operations can be set by a user through the operation panel. Consequently, it enables the user to check the alignment state of the sheet bundle SB, and to set the appropriate number of alignments as appropriate, and an alignment failure will not be invited.

(8) In the state where the sheet bundle SB is pressed by the pressing member 110, one of the alignment operation performed by the trailing end fence 51 and the tapping roller 12 and the alignment operation by the jogger fence 53 is executed first, and the other is executed later. Even if either operation is executed first, the alignment operations in the conveying direction and the direction orthogonal to the conveying direction are reliably performed in the state where the curl and bulge of the sheet bundle SB are regulated, and excellent alignment accuracy can be obtained.

(9) The pressing member 110 presses the sheet or sheet bundle at a pressing force or with a pressing space that allows the sheet to move in the alignment operation performed by the trailing end fence 51 and the tapping roller 12 and the alignment operation by the jogger fence 53 during the press operation. Accordingly, the alignment operations are reliably executed on the ends of the sheet, and excellent alignment accuracy can be obtained.

A sheet recited in claims corresponds to the reference numeral S in the embodiment, a stacking unit to the end surface processing tray F, a sheet bundle to the reference numeral SB, a first alignment unit to the trailing end reference fences 51, 51*a* and 51*b* and the tapping roller 12, a second alignment unit to the jogger fences 53, 53*a* and 53*b*, a pressing unit to the pressing members 110, 110*a*, 110*b* and 110*c*, a control unit to the CPU_PD1, a binding unit to the end surface binding stapler S1, a moving unit to the slide shaft 141, the slide groove 142, the timing belt 159*b*, the pulleys 159*c* and 159*d*, and the stapler moving motor 159, a setting unit to the CPU_PD1, an operation panel to the reference numeral PR1, and an image forming system to the image forming apparatus PR and the sheet postprocessing apparatus PF, respectively.

According to the present invention, it is possible to reliably align a bundle of sheets in a sheet conveying direction and a direction orthogonal to the sheet conveying direction even if a bend and the like occur on the sheet bundle to thereby excellent alignment accuracy.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a stacker configured to stack a sheet conveyed thereto;

a first alignment device configured to align the sheet or the bundle of sheets stacked in the stacker in a direction orthogonal to a sheet conveying direction;

a pressing device movable in a direction perpendicular to the sheet conveying direction and configured to press the bundle of sheets at an end portion thereof on a predetermined one side;

a controller configured to cause the first alignment device to execute an alignment operation during a press operation of the sheet or the bundle of sheets performed by the pressing device;

a binder configured to bind the bundle of sheets that has been aligned by the first alignment device, wherein the pressing device presses an end of the bundle of sheets on a side to be bound by the binder; and, a moving device configured to move the binder in the direction orthogonal to the sheet conveying direction, wherein the pressing device moves in the same direction in synchronization with the movement of the binder by the moving device.

2. The sheet processing apparatus according to claim 1, wherein an alignment operation by the first alignment device is performed in parallel with the press operation performed by the pressing device.

3. The sheet processing apparatus according to claim 1, wherein the press operation performed by the pressing device is executed first, and the alignment operation performed by the first alignment device is subsequently performed under the pressed state.

4. The sheet processing apparatus according to claim 1, wherein the pressing device presses the sheet or the bundle of sheets at a pressing force or with a pressing space that allows the sheet to be moved by the first alignment unit during the press operation.

5. An image forming system comprising the sheet processing apparatus according to claim 1.

6. The sheet processing apparatus according to claim 1, further comprising a second alignment device configured to align the sheet or a bundle of sheets stacked in the stacker in the sheet conveying direction, wherein the controller is further configured to cause the second alignment device to execute an alignment operation during a press operation of the sheet or bundle of sheets performed by the pressing device.

7. A sheet processing apparatus comprising:

a stacker configured to stack a sheet conveyed thereto;

a first alignment device configured to align the sheet or the bundle of sheets stacked in the stacker in a direction orthogonal to a sheet conveying direction;

a pressing device movable in a direction perpendicular to the sheet conveying direction and configured to press the bundle of sheets at an end portion thereof on a predetermined one side;

a controller configured to cause the first alignment device to execute an alignment operation during a press operation of the sheet or the bundle of sheets performed by the pressing device; and a setting unit that sets the alignment operations of the first alignment device and the press operation of the pressing device as a combination of components to be activated during one alignment operation, wherein the setting unit changes the number of components of alignment operations in accordance with a sheet size or the number of sheets to be bound.

8. The sheet processing apparatus according to claim 7, wherein an alignment operation by the first alignment device is performed in parallel with the press operation performed by the pressing device.

9. The sheet processing apparatus according to claim 7, wherein the press operation performed by the pressing device is executed first, and the alignment operation performed by the first alignment device is subsequently performed under the pressed state.

10. The sheet processing apparatus according to claim 7, further comprising a binder configured to bind the bundle of sheets that has been aligned by the first alignment device, wherein the pressing device presses an end of the bundle of sheets on a side to be bound by the binder.

11. The sheet processing apparatus according to claim 7, wherein the pressing device presses the sheet or the bundle of sheets at a pressing force or with a pressing space that allows the sheet to be moved by the first alignment unit during the press operation.

12. An image forming system comprising the sheet processing apparatus according to claim 7.

13. The sheet processing apparatus according to claim 7, further comprising a second alignment device configured to align the sheet or a bundle of sheets stacked in the stacker in the sheet conveying direction, wherein the controller is further configured to cause the second alignment device to execute an alignment operation during a press operation of the sheet or bundle of sheets performed by the pressing device.

14. A sheet processing apparatus comprising:

a stacker configured to stack a sheet conveyed thereto;

a first alignment device configured to align the sheet or the bundle of sheets stacked in the stacker in a direction orthogonal to a sheet conveying direction;

a pressing device movable in a direction perpendicular to the sheet conveying direction and configured to press the bundle of sheets at an end portion thereof on a predetermined one side;

a controller configured to cause the first alignment device to execute an alignment operation during a press operation of the sheet or the bundle of sheets performed by the pressing device; and an operation panel that allows a user to set the number of components of alignment operations, regarding the alignment operations of the first alignment device and the press operation of the pressing device as a combination of components to be activated during one alignment operation.

15. The sheet processing apparatus according to claim 14, wherein an alignment operation by the first alignment device is performed in parallel with the press operation performed by the pressing device.

16. The sheet processing apparatus according to claim 14, wherein the press operation performed by the pressing device is executed first, and the alignment operation performed by the first alignment device is subsequently performed under the pressed state.

17. The sheet processing apparatus according to claim 14, further comprising a binder configured to bind the bundle of sheets that has been aligned by the first alignment device, wherein the pressing device presses an end of the bundle of sheets on a side to be bound by the binder.

18. The sheet processing apparatus according to claim 14, wherein the pressing device presses the sheet or the bundle of sheets at a pressing force or with a pressing space that allows the sheet to be moved by the first alignment unit during the press operation.

19. An image forming system comprising the sheet processing apparatus according to claim 14.

20. The sheet processing apparatus according to claim 14, further comprising a second alignment device configured to align the sheet or a bundle of sheets stacked in the stacker in the sheet conveying direction, wherein the controller is further configured to cause the second alignment device to execute an alignment operation during a press operation of the sheet or bundle of sheets performed by the pressing device.

* * * * *